US011808158B2

(12) United States Patent
Yang et al.

(10) Patent No.: US 11,808,158 B2
(45) Date of Patent: Nov. 7, 2023

(54) ELECTROHYDROSTATIC ACTUTION SYSTEM, HYDRAULIC CIRCUIT OF ELECTROHYDROSTATIC ACTUTION SYSTEM, AND STEAM TURBINE SYSTEM INCLUDING SAME

(71) Applicant: MOOG JAPAN LTD., Kanagawa (JP)

(72) Inventors: Jiong Yang, Hiratsuka (JP); Hidemitsu Takamoto, Hiratsuka (JP); Naritoyo Shibata, Hiratsuka (JP)

(73) Assignee: MOOG JAPAN LTD., Kanagawa (JP)

( * ) Notice: Subject to any disclaimer, the term of this patent is extended or adjusted under 35 U.S.C. 154(b) by 185 days.

(21) Appl. No.: 17/441,663

(22) PCT Filed: Apr. 27, 2020

(86) PCT No.: PCT/JP2020/017941
§ 371 (c)(1),
(2) Date: Sep. 21, 2021

(87) PCT Pub. No.: WO2021/049093
PCT Pub. Date: Mar. 18, 2021

(65) Prior Publication Data

US 2022/0145770 A1 May 12, 2022

(30) Foreign Application Priority Data

Sep. 13, 2019 (JP) ..... 2019-167187

(51) Int. Cl.
*F01D 17/10* (2006.01)
*F01D 21/18* (2006.01)
(Continued)

(52) U.S. Cl.
CPC ..... *F01D 17/10* (2013.01); *F01D 21/18* (2013.01); *F15B 13/01* (2013.01); *F15B 13/027* (2013.01);
(Continued)

(58) Field of Classification Search
CPC ..... F15B 11/024; F15B 2011/0243; F15B 20/002; F15B 20/004; F15B 21/0423;
(Continued)

(56) References Cited

U.S. PATENT DOCUMENTS 3,713,291 A * 1/1973 Kubik ..... F15B 11/02 60/473
3,864,911 A * 2/1975 Gellatly ..... F16H 39/02 60/486
(Continued)

FOREIGN PATENT DOCUMENTS

CN 108374696 A 8/2018
DE 20 25 836 A1 12/1971
(Continued)

OTHER PUBLICATIONS

An Office Action mailed by China National Intellectual Property Administration dated Feb. 2, 2023, which corresponds to Chinese Patent Application No. 202080023131.5 and is related to U.S. Appl. No. 17/441,663; with English language translation.
(Continued)

*Primary Examiner* — Michael Leslie
(74) *Attorney, Agent, or Firm* — Studebaker & Brackett PC

(57) ABSTRACT

Provided is an electrohydrostatic actuation system including an emergency shut-off circuit to be actuated stably with a simple configuration. The electrohydrostatic actuation system includes: a hydraulic cylinder (24) including a piston (25) to which a valve element is connected, a first chamber (24A), and a second chamber (24B); a hydraulic pump (21) configured to supply hydraulic fluid to the first chamber (24A) or the second chamber (24B); a servo motor (M) configured to drive the hydraulic pump (21); a shuttle valve (11) configured to establish communication to a downstream side under a state in which a hydraulic pressure generated by
(Continued)

the hydraulic pump (21) is maintained; a solenoid valve (12) configured to receive the hydraulic pressure via the shuttle valve (11) as a pilot pressure; and a logic valve (13) including a first port configured to receive the pilot pressure from the solenoid valve (12), and a second port to be communicated to the first chamber (24A) of the hydraulic cylinder (24). When the solenoid valve (12) is brought to a de-energized state, the pilot pressure of the logic valve (13) is released, and the logic valve (13) causes the hydraulic fluid in the first chamber (24A) communicated to the second port to flow into the second chamber (24B) so that emergency shut-off of the valve element is achieved by a return spring (26).

15 Claims, 19 Drawing Sheets

(51) Int. Cl.
*F15B 13/01* (2006.01)
*F15B 13/02* (2006.01)
*F15B 20/00* (2006.01)

(52) U.S. Cl.
CPC ..... *F15B 13/028* (2013.01); *F15B 20/002* (2013.01); *F15B 20/004* (2013.01); *F05D 2220/31* (2013.01); *F05D 2270/303* (2013.01)

(58) Field of Classification Search
CPC ..... F15B 2211/611; F04B 49/002; F16H 61/433; F01B 17/10; F01B 21/18
See application file for complete search history.

(56) References Cited

U.S. PATENT DOCUMENTS 4,147,325 A 4/1979 McGee
4,807,517 A * 2/1989 Daeschner ..... F15B 9/12 91/464
5,137,253 A * 8/1992 Frey ..... F01D 17/26 251/30.02
6,892,534 B2 * 5/2005 Silva ..... F15B 1/022 60/404
8,341,956 B2 * 1/2013 Makino ..... F04B 49/002 60/443
8,753,067 B2 * 6/2014 Shindo ..... F01D 17/145 415/118
8,997,473 B2 * 4/2015 Olson ..... F15B 15/18 60/329
10,578,227 B2 * 3/2020 Goll ..... F15B 20/00
10,851,772 B2 * 12/2020 Junginger ..... F15B 7/006
10,871,080 B2 12/2020 Tsunekawa et al.
11,428,246 B2 * 8/2022 Miyajima ..... F01D 21/00
2015/0152887 A1 6/2015 Helbig et al.
2015/0334918 A1 11/2015 Daining
2018/0172177 A1 6/2018 Goll
2018/0216485 A1 8/2018 Tsunekawa et al.

FOREIGN PATENT DOCUMENTS

DE 10 2013 216 790 A1 2/2015
EP 2930410 A1 10/2015
JP 2943459 B2 8/1999
JP 2018-123732 A 8/2018
JP 6746511 B2 8/2020

OTHER PUBLICATIONS

International Search Report issued in PCT/JP2020/017941; dated Jun. 30, 2020.
An Office Action; "Notice of Reasons for Refusal," mailed by the Japanese Patent Office dated Jan. 5, 2023, which corresponds to Japanese Patent Application No. 2019-167187 and is related to U.S. Appl. No. 17/441,663; with English language translation.
Communication Pursuant to Rule 164(1) EPC issued by the European Patent Office dated Jul. 25, 2023, which corresponds to EP20863439.4-1012 and is related to U.S. Appl. No. 17/441,663.

* cited by examiner

ELECTROHYDROSTATIC ACTUTION SYSTEM, HYDRAULIC CIRCUIT OF ELECTROHYDROSTATIC ACTUTION SYSTEM, AND STEAM TURBINE SYSTEM INCLUDING SAME

TECHNICAL FIELD

The present invention relates to an electrohydrostatic actuation system, a hydraulic circuit of an electrohydrostatic actuation system for a steam turbine, and to a steam turbine system including the same.

BACKGROUND ART

In Patent Literature 1, there is disclosed a fail-safe actuation system configured so that, in a working circuit configured to actuate, by means of a hydraulic pressure, an actuator for use to drive a valve of a steam turbine or the like, the actuator is moved to a safety position in a case of a failure. In Patent Literature 2, there is disclosed a configuration using a trip solenoid valve and a logic valve in order to quickly close a valve of a steam turbine or the like.

CITATION LIST

Patent Literature

PTL 1: US 2015/0152887
PTL 2: Japanese Patent No. 2943459

SUMMARY OF INVENTION

Technical Problem

As described above, in the actuator configured to drive the valve of the steam turbine or the like, a mechanism for achieving emergency shut-off of the valve has various modes, but particularly in an electrohydrostatic actuation system, it is required to use a solenoid valve to achieve the emergency shut-off. It is required to stably actuate the mechanism for achieving the emergency shut-off with a simple configuration.

When electric power to a hydraulic pump configured to generate a hydraulic pressure is lost, it is required to activate a fail-safe function to promptly bring a valve element into a valve closed state. At this time, it is required to protect the hydraulic pump from hydraulic fluid refluxed to the hydraulic pump.

The hydraulic pump is sometimes operated beyond the rated output due to overload, and a servo motor is sometimes overheated at this time. It is required to control a pump displacement in accordance with an external load, and to operate under a state in which a load to the hydraulic pump is suppressed.

The hydraulic fluid is sealed in a completely closed system, and hence the hydraulic fluid is provided under a state in which a circulation amount of the hydraulic fluid is small and thus the temperature is liable to rise. Thus, there are problems in that the viscosity or other performance of the hydraulic fluid is decreased early, and efficiency of the electrohydrostatic actuation system is decreased. Accordingly, it is required to prevent the performance of the hydraulic fluid from being deteriorated.

The present invention has an object to provide an electrohydrostatic actuation system including an emergency shut-off circuit to be actuated stably with a simple configuration. The present invention has another object to provide an electrohydrostatic actuation system including a hydraulic circuit configured to protect a hydraulic pump at the time of fail-safe shut-off. The present invention has further another object to provide an electrohydrostatic actuation system capable of performing, in accordance with an external load, an operation under a state in which a load to a hydraulic pump is suppressed. The present invention has further another object to provide an electrohydrostatic actuation system in which performance of hydraulic fluid is stabilized.

Solution to Problem

In order to solve the above-mentioned problems, according to the present invention, there is provided an electrohydrostatic actuation system including: a hydraulic cylinder including a piston to which a valve element biased by a return spring is connected, a first chamber, and a second chamber; a hydraulic pump configured to supply hydraulic fluid to the first chamber or the second chamber; an electric motor configured to drive the hydraulic pump; a shuttle valve configured to establish communication to a downstream side under a state in which a hydraulic pressure generated by the hydraulic pump is maintained; a solenoid valve configured to receive the hydraulic pressure via the shuttle valve as a pilot pressure; and a logic valve including a first port configured to receive the pilot pressure from the solenoid valve, and a second port communicated to the first chamber of the hydraulic cylinder, wherein, when the solenoid valve is brought to a de-energized state, the pilot pressure of the logic valve is released, and the logic valve causes the hydraulic fluid in the first chamber communicated to the second port to flow into the second chamber so that emergency shut-off of the valve element is achieved by the return spring.

Advantageous Effects of Invention

According to the present invention, the electrohydrostatic actuation system including an emergency shut-off circuit to be actuated stably with a simple configuration can be provided. Further, the electrohydrostatic actuation system including a hydraulic circuit configured to protect the hydraulic pump at the time of fail-safe shut-off can be provided. Still further, the electrohydrostatic actuation system capable of performing, in accordance with an external load, an operation under a state in which a load to the hydraulic pump is suppressed can be provided. Yet further, the electrohydrostatic actuation system in which performance of the hydraulic fluid is stabilized can be provided.

DESCRIPTION OF EMBODIMENTS

Example 1

Figure 1:
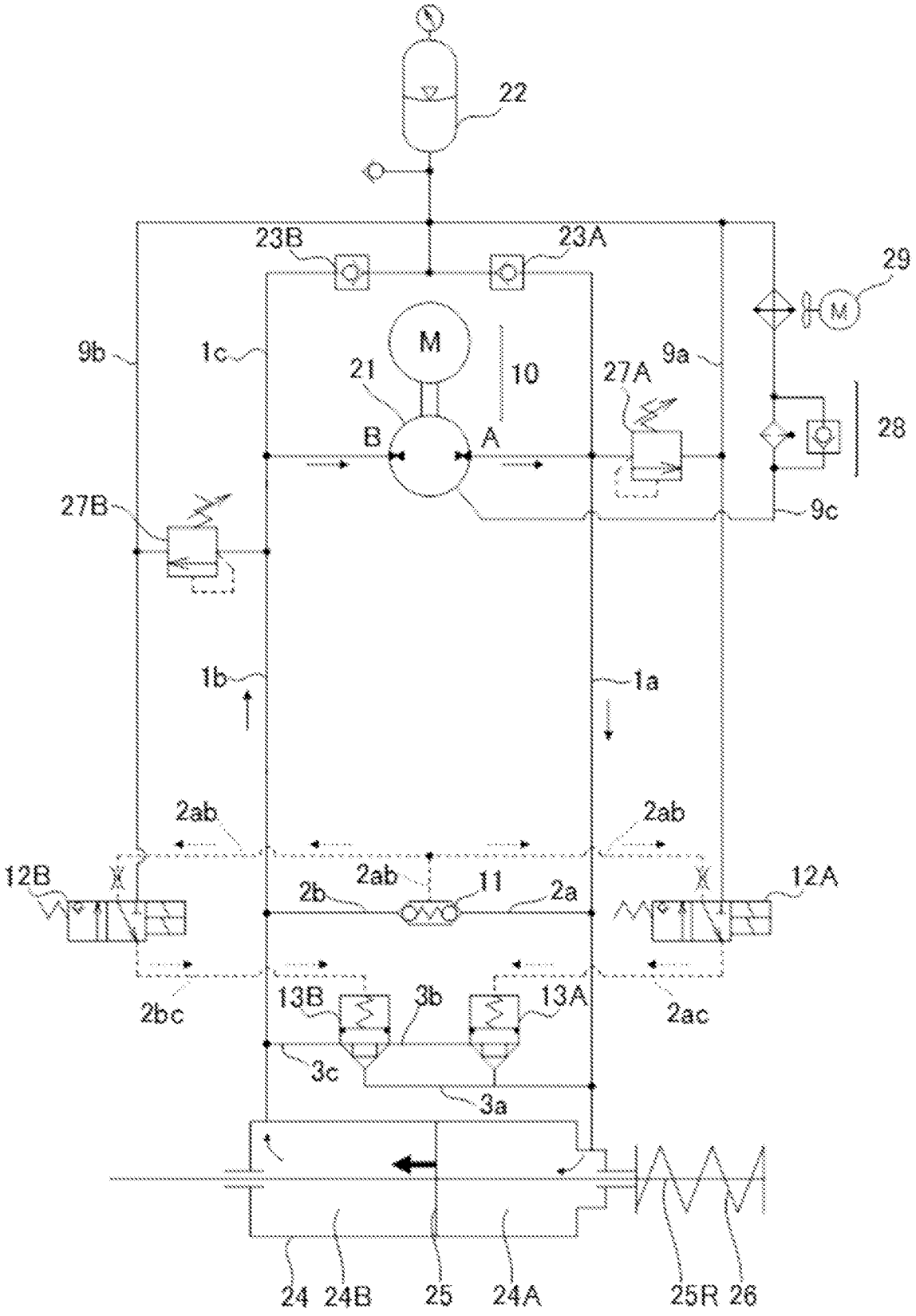
FIG. 1 is a hydraulic schematic for illustrating a normal valve opening operation of Example 1 of the present invention.

Now, modes for carrying out the present invention are described in detail with reference to the accompanying drawings. FIG. 1 is a hydraulic schematic for illustrating a normal valve opening operation in an electrohydrostatic actuation system of Example 1 of the present invention. Throughout all the drawings, the broken line indicates a pilot pressure with respect to a valve to be controlled, and the broken-line arrow indicates a state in which the pilot pressure is acting. The solid-line arrow indicates a direction of a flow of hydraulic fluid.

The electrohydrostatic actuation system of Example 1 of the present invention includes a pump/motor unit 10 in a hydraulic circuit. The pump/motor unit 10 includes a hydraulic pump 21 formed of a radial piston pump, and the hydraulic pump 21 is to be driven and controlled by a servo motor M (electric motor) capable of performing driving in both forward and reverse directions. The configuration of the radial piston pump may be a pump of other types, such as an axial piston pump or a gear pump.

A pressure accumulator 22 is included in the hydraulic circuit. The pressure accumulator 22 always maintains a pressurizing state so that the hydraulic circuit can be filled with the hydraulic fluid even when some leakage from the hydraulic circuit occurs. The hydraulic circuit includes two check valves 23A and 23B for cavitation prevention, and the hydraulic fluid from the pressure accumulator 22 is supplied to the hydraulic circuit via the check valves 23A and 23B. Further, the check valves 23A and 23B keep the pressure constant, and hence occurrence of cavitation is prevented. The pressure accumulator 22 may also be a pressure pump with a reservoir tank.

A hydraulic cylinder 24 serving as a hydraulic actuator and a piston 25 are included. The piston 25 including a piston rod 25R is arranged inside the hydraulic cylinder 24. The inside of the hydraulic cylinder 24 is divided by this piston 25 into two chambers, namely, a first chamber 24A and a second chamber 24B. The piston 25 is driven when the hydraulic pump 21 supplies the hydraulic fluid to the first chamber 24A or the second chamber 24B of the hydraulic cylinder 24, or when the hydraulic pump 21 collects the hydraulic fluid from the second chamber 24B or the first chamber 24A. One side of the piston rod 25R is connected to the piston 25, and another side of the piston rod 25R is connected to a steam valve (valve element) (not shown). When the piston rod 25R is driven in both extending and contracting directions, the steam valve can be opened or closed. Further, a return spring 26 is included between the steam valve and the hydraulic cylinder 24, and the steam valve is biased in a valve closing direction by the return spring 26. The hydraulic cylinder 24 may be a hydraulic actuator of other types, for example, a hydraulic motor.

Relief valves 27A and 27B are included in the hydraulic circuit. The relief valves 27A and 27B release the hydraulic fluid to fluid passages 9*a* and 9*b* being return pipes, respectively, when the pressure of the hydraulic circuit exceeds a set pressure, to thereby prevent the pressure in the hydraulic circuit from overrising. A filter and bypass valve 28 is connected to a fluid passage 9*c* being a return pipe of the hydraulic pump 21 as a valve for filtering the hydraulic fluid. Further, a radiator and cooling fan 29 serving as an active cooling circuit configured to cool the hydraulic fluid may be provided in series to the filter and bypass valve 28.

Next, a normal valve opening operation is described. Originally, the entire hydraulic circuit is equally pressurized by the pressure accumulator 22 to a defined pressure which is, as an example, a pressure of about 0.5 MPa. The pressure is set here as 0.5 MPa, but the pressure can be set to any other pressure values. When a controller (not shown) outputs a command to open the steam valve, the pump/motor unit 10 discharges high-pressure hydraulic fluid from a port A (discharge port) of the hydraulic pump 21. The hydraulic fluid passes through a fluid passage 1*a* to be supplied to the first chamber 24A of the hydraulic cylinder 24. Simultaneously, the hydraulic fluid present in the second chamber 24B of the hydraulic cylinder 24 passes through a fluid passage 1*b* to flow toward the hydraulic pump 21, and is sucked through a port B of the hydraulic pump 21.

When the pressure generated by the hydraulic pump 21 is not large enough to surpass an external force, for example, a pressure caused by steam or the return spring 26, the piston 25 does not move. However, when the pressure reaches a pressure surpassing the external force, the piston 25 moves so that the steam valve is opened. The hydraulic cylinder 24 is a double-rod cylinder having equal pressure receiving areas on both sides thereof, and hence an inflow amount of the hydraulic fluid to the first chamber 24A is the same as an outflow amount thereof from the second chamber 24B. The hydraulic pump 21 is controlled so that a desired opening degree of the steam valve can be obtained, and further, the desired opening degree can be maintained.

Next, a normal valve closing operation is described. When the return spring 26 is to close the steam valve by its biasing force, a reflux at a large flow rate of hydraulic fluid may be caused to close the valve at an excessive speed, but the speed to close the valve can be controlled when the pressure to be generated by the pump/motor unit 10 is controlled. That is, the speed to close the steam valve is controlled under a state in which the pressure generated by the pump/motor unit 10 acts against the biasing force. Then, in order to obtain an optimum valve closing speed, the hydraulic pump 21 sucks the hydraulic fluid flowing from the first chamber 24A to the port A, and simultaneously discharges the hydraulic fluid through the port B (discharge port) to supply the hydraulic fluid to the second chamber 24B. At the time of the normal valve opening and closing operations, the pressure controlled by the pump/motor unit 10 is lower than set pressures of the relief valves 27A and 27B, and hence the relief valves 27A and 27B are kept closed.

Figure 2:
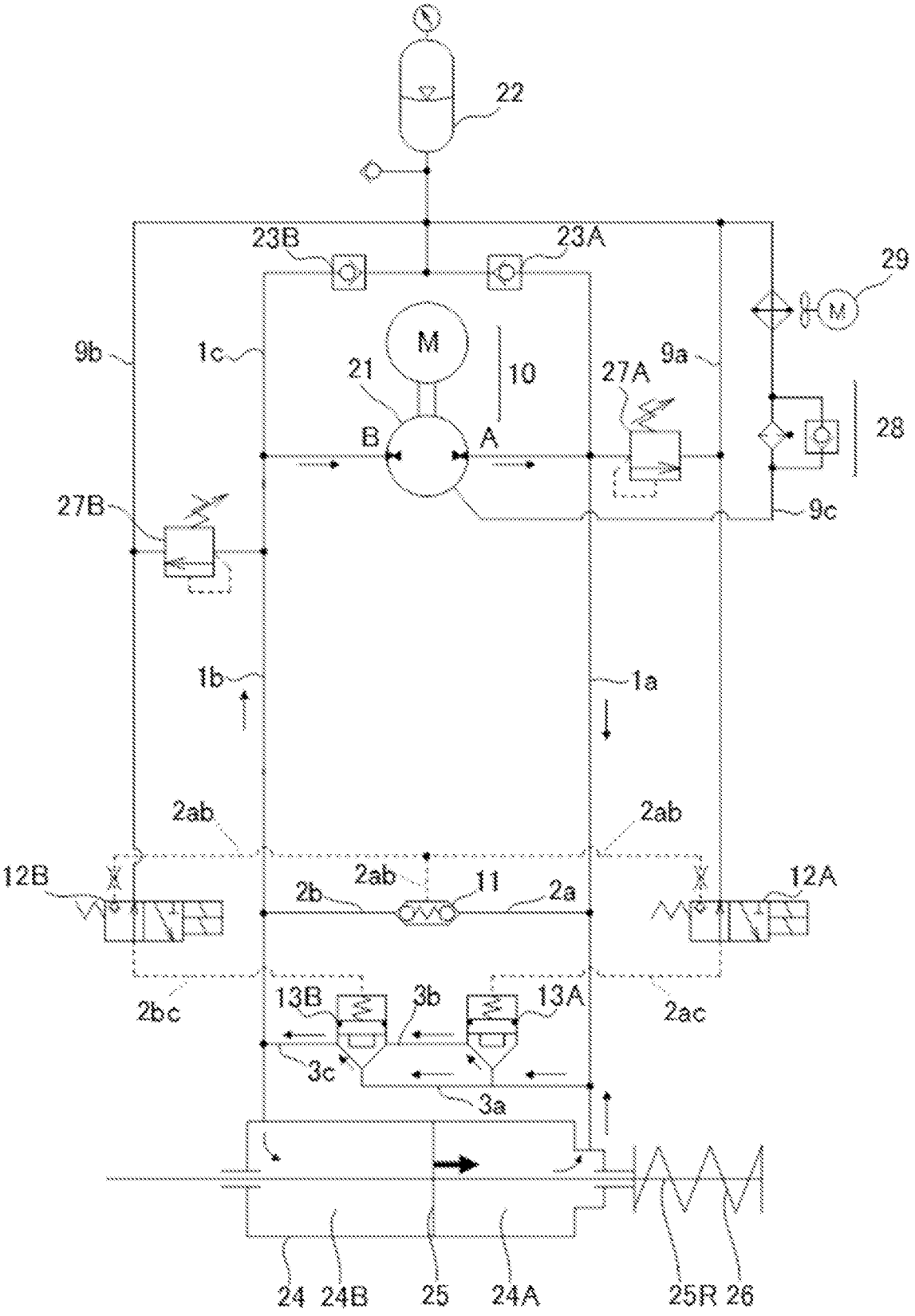
FIG. 2 is a hydraulic schematic for illustrating an actuation at the time of emergency shut-off of Example 1 of the present invention.

Next, an emergency shut-off circuit of Example 1 of the present invention is described. The hydraulic circuit of Example 1 includes a shuttle valve 11 (first valve), at least one trip solenoid valve 12A, 12B (second valve, described as "solenoid valve 12" as a representative thereof), and at least one logic valve 13A, 13B (third valve, described as "logic valve 13" as a representative thereof). FIG. 2 is a hydraulic schematic for illustrating an actuation at the time of emergency shut-off in the electrohydrostatic actuation system of Example 1 of the present invention.

The shuttle valve 11 is a valve of a so-called "back-to-back check" type including therein two valve elements, for example, poppets or balls, and a preloaded spring between those two valve elements. The hydraulic fluid in a fluid passage 2*a* branched from the fluid passage 1*a* is input to the shuttle valve 11 via one valve element, and further, the hydraulic fluid in a fluid passage 2*b* branched from the fluid passage 1*b* is input to the shuttle valve 11 via the other valve element. Then, with the preloaded spring in the shuttle valve 11, an inlet side of the input having a higher pressure of those two input pressures is communicated to an outlet side (downstream side). For example, when the steam valve is to be opened, the pressure of the hydraulic fluid in the fluid passage 2*a* is higher than the pressure of the hydraulic fluid in the fluid passage 2*b*, and hence the hydraulic fluid from the fluid passage 2*a* flows into the shuttle valve 11 from the inlet side, and is communicated to the outlet side. However, when the steam valve is to be closed, the strength of the steam valve closing operation is sometimes intentionally increased by bringing the pressure of the hydraulic fluid in the fluid passage 2*b* to be relatively higher than the pressure of the hydraulic fluid in the fluid passage 2*a*. In such a case, the hydraulic fluid from the fluid passage 2*b* flows into the shuttle valve 11 from the inlet side, and is communicated to the outlet side. That is, the shuttle valve 11 is one valve configured to communicate, to the downstream side, the hydraulic fluid having a higher pressure between the pressure of the hydraulic fluid to be supplied and the pressure of the hydraulic fluid to be collected. The outlet side of the shuttle valve 11 is connected to a fluid passage 2*ab*, and the fluid passage 2*ab* (trip line) is further branched into two paths, which are applied as pilot pressures to the trip solenoid valves 12A and 12B, respectively. As described above, through use of the shuttle valve 11, an optimum pressure can be selected from two hydraulic sources. Further, the shuttle valve 11 allows integration and simplification of the hydraulic circuit as compared to a case in which two check valves are used, and hence production cost and time and effort can be reduced.

The trip solenoid valves 12A and 12B are normally energized, and the pilot pressures from the shuttle valve 11 pass through a fluid passage 1*ac* and a fluid passage 2*bc* via the trip solenoid valves 12A and 12B to be applied to the two logic valves 13A and 13B, respectively.

The two logic valves 13A and 13B are each a valve configured to close by an internal return spring, and each include a first port to which the fluid passage 1*ac* or the fluid passage 2*bc* for supplying the pilot pressure from the trip solenoid valve 12A or 12B is connected. Further, the two logic valves 13A and 13B each include a second port to which a fluid passage 3*a* branched from the fluid passage 1*a* is connected. That is, the second port is communicated to the first chamber 24A of the hydraulic cylinder 24 via the fluid passage 1*a* and the fluid passage 3*a*. Further, the logic valve 13A and the logic valve 13B are arranged in parallel to the first chamber 24A. A fluid passage 3*b* through which the hydraulic fluid from the fluid passage 3*a* is caused to flow is connected to the logic valve 13A, and the fluid passage 3*b* is connected to the logic valve 13B. A fluid passage 3*c* connected to the fluid passage 1*b* is further connected to the logic valve 13B. The hydraulic fluid flowing through this fluid passage 3*b* flows to the fluid passage 3*c* via the logic valve 13B. Then, a sum of the pilot pressure and the biasing force of the internal return spring acts against the pressure from the hydraulic cylinder 24, thereby closing the fluid passage 3*a* from the first chamber 24A of the hydraulic cylinder 24 connected to the second ports of the logic valves 13A and 13B.

When an emergency shut-off signal is received from the controller (not shown), the trip solenoid valve 12 is brought to a de-energized state, and the pilot pressure applied to the logic valve 13 is released. Then, the logic valve 13 is opened when the pressure from the hydraulic cylinder 24 surpasses the biasing force of the internal return spring. Thus, the fluid passage 1*a*, the fluid passage 3*a*, the fluid passage 3*b*, the fluid passage 3*c*, and the fluid passage 1*b* which are connected to the first chamber 24A are communicated to each other. With this communication, the hydraulic fluid in the first chamber 24A can pass through the fluid passage 1*a*, the fluid passage 3*a*, the fluid passage 3*b*, the fluid passage 3*c*, and the fluid passage 1*b* to directly and quickly flow into the second chamber 24B. With this quick inflow of the hydraulic fluid, the steam valve biased in the valve closing direction by the biasing force of the return spring 26 can be quickly closed.

As described above, the hydraulic fluid in the first chamber 24A is rapidly refluxed from the first chamber 24A to the second chamber 24B without passing through the hydraulic pump 21, and hence the piston rod 25R can quickly move to quickly close the steam valve. Unless the trip solenoid valve 12 is brought to a de-energized state, the pilot pressure in the trip line is maintained by the shuttle valve 11, and hence the logic valve 13 is kept closed.

As described above, the emergency shut-off circuit of Example 1 includes the shuttle valve 11, the trip solenoid valve 12, and the logic valve 13, thereby being capable of quickly closing the steam valve. In particular, the pilot pressure in the trip line is confined by the shuttle valve 11, and hence the logic valve 13 is kept closed. Thus, there is provided such an excellent effect that the emergency shut-off circuit can be actuated stably with a simple configuration.

Example 2

Figure 3:
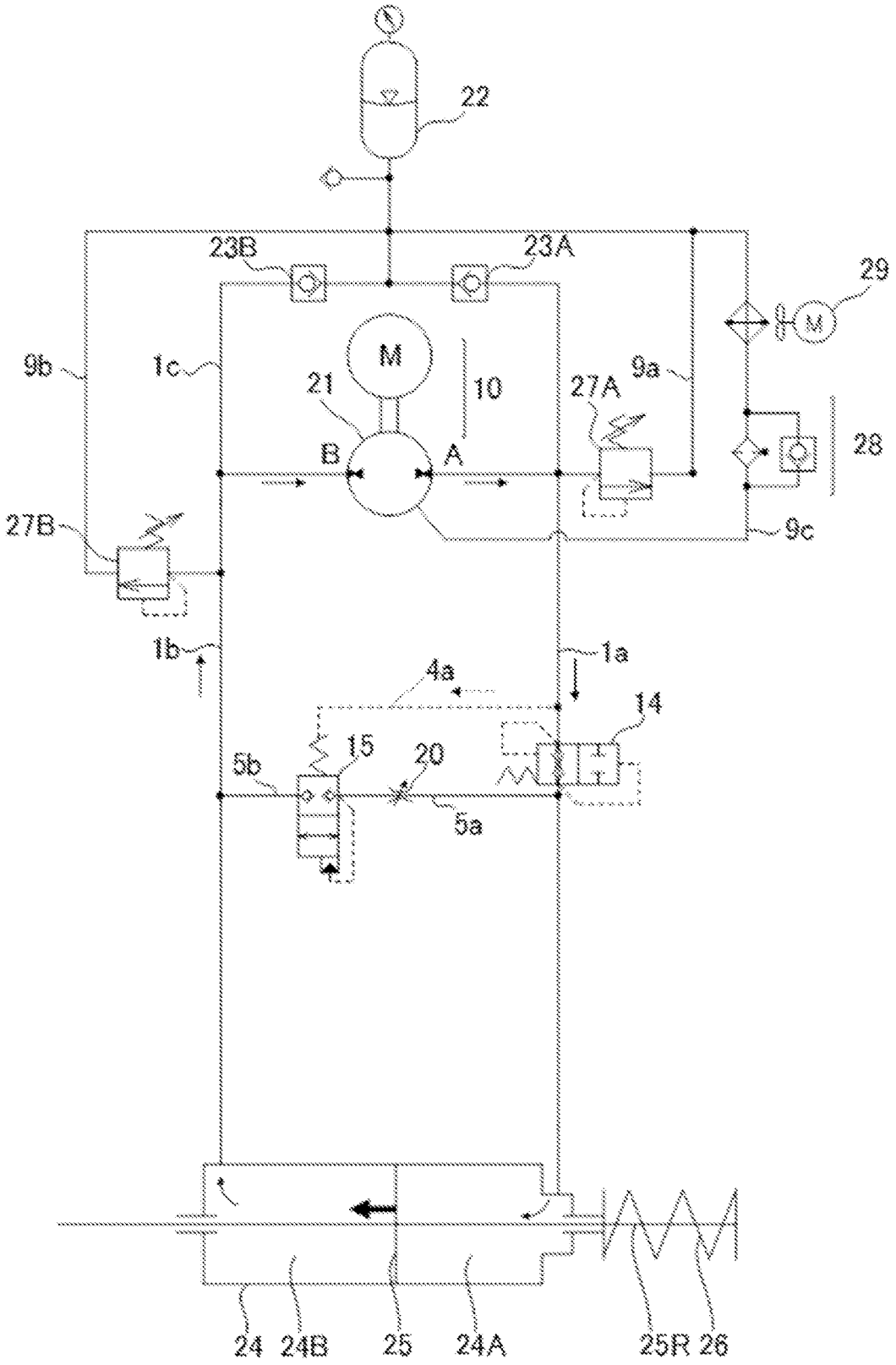
FIG. 3 is a hydraulic schematic for illustrating a normal valve opening operation of Example 2 of the present invention.
Figure 4:
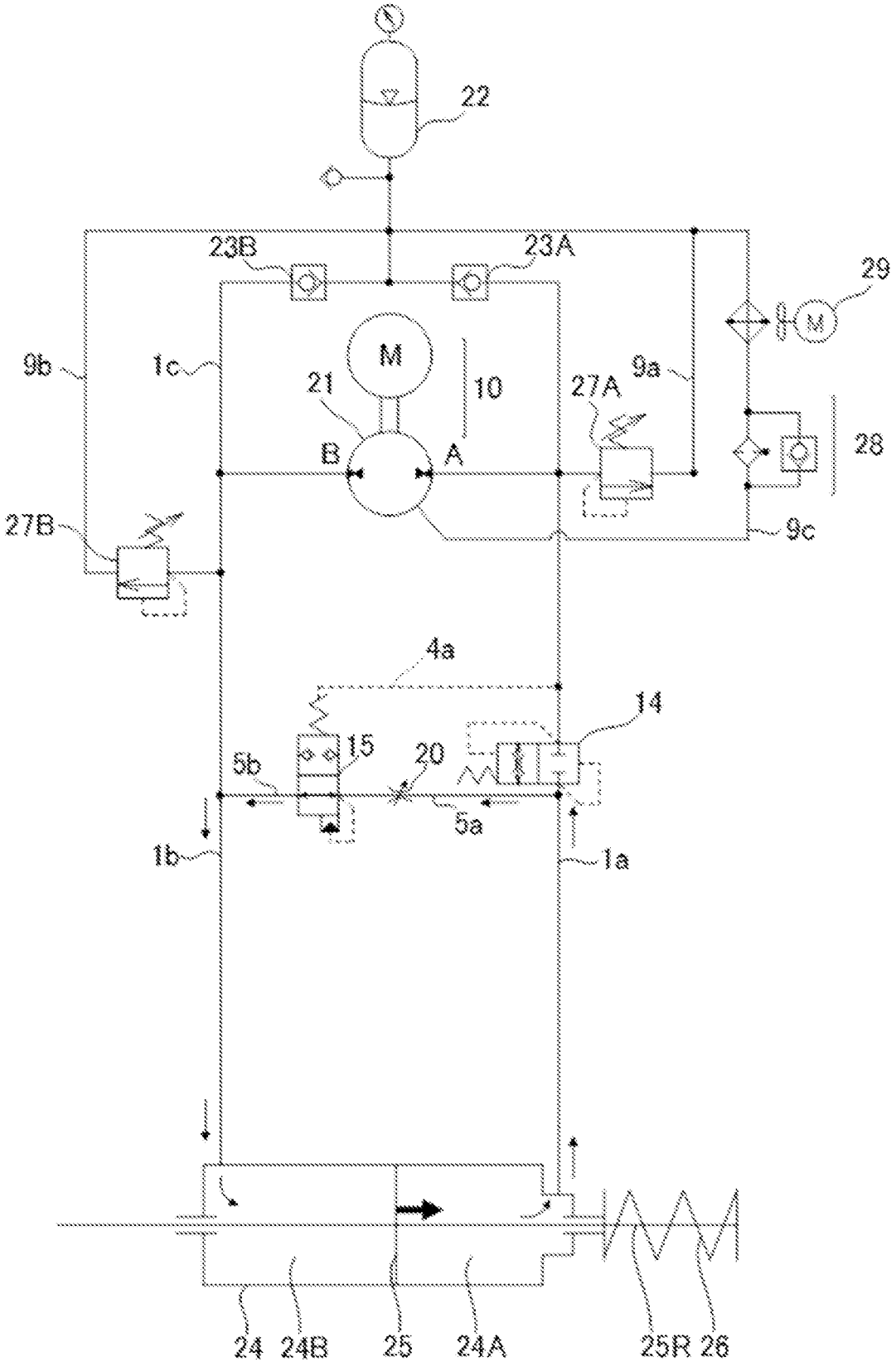
FIG. 4 is a hydraulic schematic for illustrating an actuation of fail-safe shut-off and pump/motor unit protection of Example 2 of the present invention.

A fail-safe shut-off and pump/motor unit protection circuit of Example 2 of the present invention is described. FIG. 3 is a hydraulic schematic for illustrating a normal valve opening operation in an electrohydrostatic actuation system including the fail-safe shut-off and pump/motor unit protection circuit of Example 2 of the present invention. FIG. 4 is a hydraulic schematic for illustrating an actuation of the fail-safe shut-off and pump/motor unit protection circuit of Example 2 of the present invention.

First, with reference to FIG. 3, the electrohydrostatic actuation system including the fail-safe shut-off and pump/motor unit protection circuit is described. The hydraulic circuit includes a fuse valve 14 (fourth valve) and a logic valve 15 (fifth valve, second logic valve).

Next, a normal valve opening operation of Example 2 is described. Originally, the entire hydraulic circuit is equally pressurized by the pressure accumulator 22 to a defined pressure which is, as an example, a pressure of about 0.5 MPa. The pressure is set here as 0.5 MPa, but the pressure can be set to any other pressure values. When the controller (not shown) outputs the command to open the steam valve, the pump/motor unit 10 discharges high-pressure hydraulic fluid from the port A of the hydraulic pump 21. The hydraulic fluid passes through the fluid passage 1*a*, and part thereof passes through a fluid passage 4*a* branched from the fluid passage 1*a* to be applied to the logic valve 15 as a pilot pressure. A differential pressure from the pump/motor unit 10 to the hydraulic cylinder 24 is positive, and hence the hydraulic fluid in the fluid passage 1*a* after the branch passes through the fuse valve 14, and part thereof is branched to pass through a fluid passage 5*a*. Then, the hydraulic fluid passes through a throttle valve 20 provided in the fluid passage 5*a*, and is connected to the logic valve 15. Further, the hydraulic fluid in the fluid passage 1*a* after the branch is supplied to the first chamber 24A of the hydraulic cylinder 24. Simultaneously, the hydraulic fluid present in the second chamber 24B of the hydraulic cylinder 24 passes through the fluid passage 1*b* to flow toward the hydraulic pump 21, and is collected through the port B of the hydraulic pump 21.

Next, with reference to FIG. 4, the fail-safe shut-off as in Example 2 of the present invention is described. When the pump/motor unit 10 loses electric power for any external reason, the piston 25 in the hydraulic cylinder 24, which has been controlled by the flow rate of the hydraulic fluid, is brought into a free state, and the steam valve is driven in the valve closing direction by the return spring 26 exhibiting the fail-safe function. There is a problem in that, along with this fail-safe shut-off of the steam valve, the hydraulic fluid flows back to the hydraulic pump 21, and thus the hydraulic pump 21 is over-rotated. However, in Example 2, with the fuse valve 14 provided in the fluid passage 1*a*, the backflow of the hydraulic fluid to the hydraulic pump 21 is prevented.

The fuse valve 14 is configured to block, when the flow rate of the hydraulic fluid flowing through the fluid passage 1*a* becomes larger than a set value, the flow of the hydraulic fluid to the pump/motor unit 10 from the first chamber 24A on the load side of the hydraulic cylinder 24. Simultaneously, the port A of the hydraulic pump 21 loses pressure, and hence the pilot pressure applied to the logic valve 15 is lost. Thus, the logic valve 15 communicates the fluid passage 5*a* branched from the fluid passage 1*a* and a fluid passage 5*b* connected to the fluid passage 1*b* to each other. That is, the fluid passage 1*a*, the fluid passage 5*a*, the fluid passage 5*b*, and the fluid passage 1*b* which are on the downstream side (first chamber 24A side) of the fuse valve 14 are communicated to each other, and thus the hydraulic fluid in the first chamber 24A passes through the logic valve 15 to flow to the second chamber 24B, thereby being capable of achieving the fail-safe shut-off of the steam valve. The fuse valve 14 blocks the fluid passage 1*a* connected to the hydraulic pump 21, and thus the hydraulic fluid cannot flow back to the hydraulic pump 21. Accordingly, simultaneously with the fail-safe shut-off, the pump/motor unit 10 can be protected without applying an overload to the hydraulic pump 21. The speed to close the steam valve at this time can be adjusted by using the throttle valve 20.

When the fail-safe shut-off and pump/motor unit protection circuit is not included, in a case in which the pump/motor unit 10 loses electric power, the hydraulic fluid flows back to the hydraulic pump 21, and the hydraulic pump 21 is over-rotated. Further, there are problems in that cavitation and mechanical wear occur. However, provision of the fail-safe shut-off and pump/motor unit protection circuit of Example 2, there is such an effect that the occurrence of cavitation and mechanical wear can be prevented.

As described above, provision of the fail-safe shut-off and pump/motor unit protection circuit of Example 2, when electric power to the hydraulic pump 21 configured to generate a hydraulic pressure is lost, allows the valve element to be promptly brought into a valve closed state. At this time, there is provided such an excellent effect that the hydraulic pump 21 can be protected from the hydraulic fluid refluxed to the hydraulic pump 21.

Example 3

Figure 5:
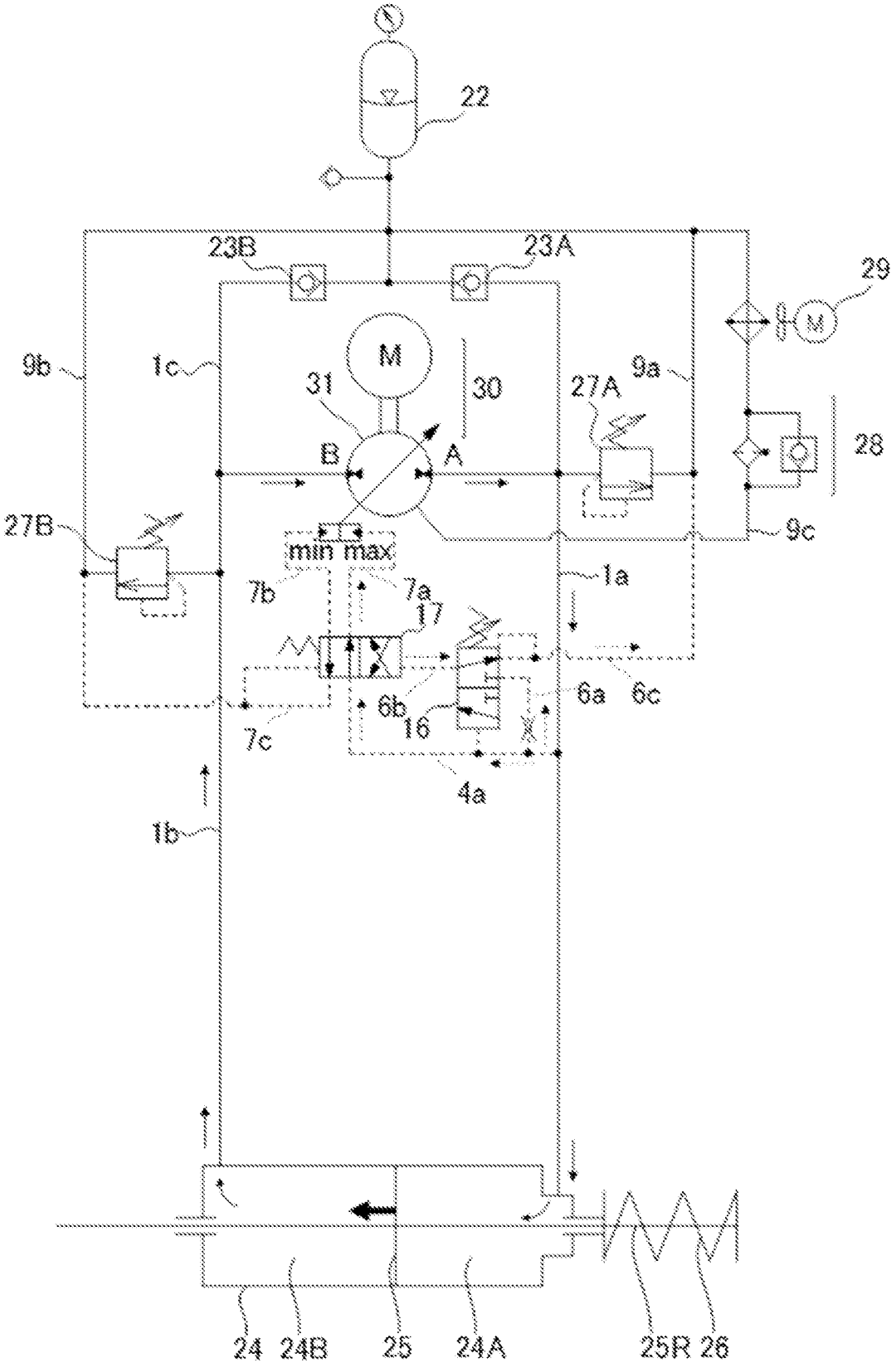
FIG. 5 is a hydraulic schematic for illustrating an actuation of displacement switching at the time when a pressure is smaller than a set value of Example 3 of the present invention.
Figure 6:
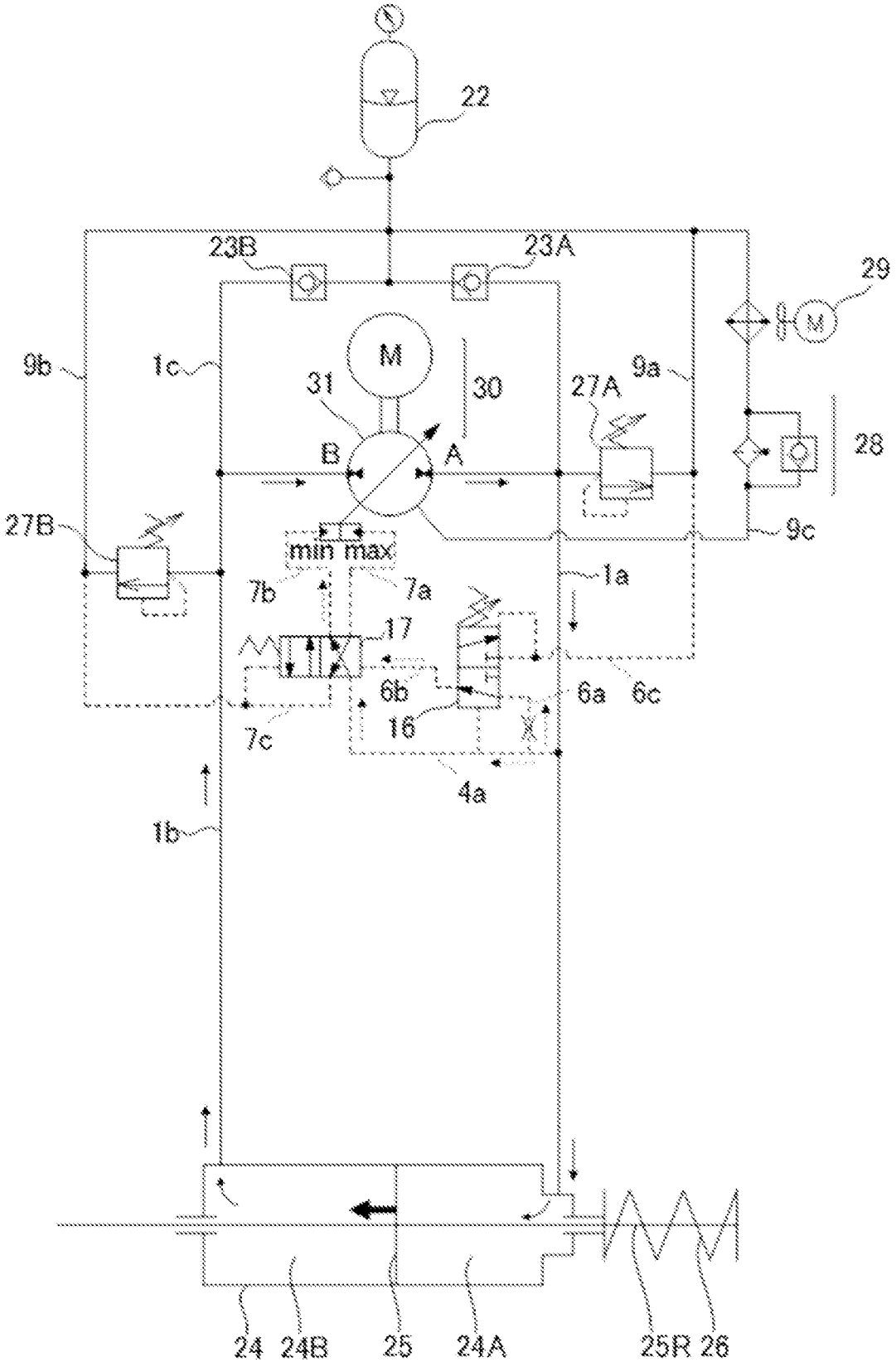
FIG. 6 is a hydraulic schematic for illustrating an actuation of the displacement switching at the time when a pressure is equal to or larger than the set value of Example 3 of the present invention.

A displacement switching circuit for a hydraulic pump 31 of Example 3 of the present invention is described. FIG. 5 is a hydraulic schematic for illustrating an actuation of displacement switching at the time when the pressure of the hydraulic fluid is smaller than a predetermined set value in an electrohydrostatic actuation system of Example 3 of the present invention. FIG. 6 is a hydraulic schematic for illustrating an actuation of the displacement switching at the time when the pressure is equal to or larger than the predetermined set value in the electrohydrostatic actuation system of Example 3 of the present invention. In Examples 1 and 2, when the steam valve is to be opened, the hydraulic pump 21 is required to generate power that can surpass the external force caused by steam and the biasing force of the return spring 26. Accordingly, the pump/motor unit 10 is sometimes operated beyond the rated output, and the servo motor M is sometimes overheated at this time. In such a case, through use of the hydraulic pump 31 of a variable displacement type of Example 3, the displacement is automatically switched in accordance with an external load, thereby being capable of performing an operation under a state in which the load to a pump/motor unit 30 is suppressed. This displacement switching is mainly actuated at the time when the valve is opened.

First, with reference to FIG. 5, a valve opening operation of Example 3 is described. The hydraulic circuit includes a sequence valve 16 (sixth valve) and a four-port, two-position pilot-operated directional control valve 17 (seventh valve). The hydraulic pump 31 is of a variable displacement type.

Originally, the entire hydraulic circuit is equally pressurized by the pressure accumulator 22 to a defined pressure which is, as an example, a pressure of about 0.5 MPa. The pressure is set here as 0.5 MPa, but the pressure can be set to any other pressure values. When the controller (not shown) outputs the command to open the steam valve, the pump/motor unit 30 discharges high-pressure hydraulic fluid from the port A of the hydraulic pump 31. The hydraulic fluid passes through the fluid passage 1*a*, and part thereof passes through the fluid passage 4*a* branched from the fluid passage 1*a* to be applied to the sequence valve 16. The fluid passage 4*a* is further connected to the four-port, two-position pilot-operated directional control valve 17, and the hydraulic fluid is applied as a pilot pressure of the four-port, two-position pilot-operated directional control valve 17. Further, the hydraulic fluid in the fluid passage 1*a* after the branch is supplied to the first chamber 24A of the hydraulic cylinder 24. Simultaneously, the hydraulic fluid present in the second chamber 24B of the hydraulic cylinder 24 passes through the fluid passage 1*b* to flow toward the hydraulic pump 31, and is collected through the port B of the hydraulic pump 31.

Next, the configuration of the hydraulic circuit for the displacement switching as in Example 3 of the present invention is described. A fluid passage 6*a*, a fluid passage 6*b*, and a fluid passage 6*c* are connected to the sequence valve 16. The fluid passage 6*a* is branched from the fluid passage 4*a* and includes a restrictor. The fluid passage 6*b* is connected to the fluid passage 4*a* and the four-port, two-position pilot-operated directional control valve 17. The fluid passage 6*c* is connected to a fluid passage 9*a*. Further, the fluid passage 4*a*, the fluid passage 6*b* connected to the sequence valve 16, and a fluid passage 7*c* are connected to the four-port, two-position pilot-operated directional control valve 17. The fluid passage 7*c* is connected to a displacement pilot line (fluid passage 7*a* and fluid passage 7*b*) to be described later and to a fluid passage 9*b*.

Next, the actuation of the displacement switching at the time when the pressure of the hydraulic fluid is smaller than the predetermined set value is described. When the pressure of the hydraulic fluid from the port A of the hydraulic pump 31 becomes lower than a set pressure of the sequence valve 16, the sequence valve 16 is actuated so that the fluid passage 6*c* connected to the fluid passage 9*a* (drain line) and the fluid passage 6*b* connected to the four-port, two-position pilot-operated directional control valve 17 are connected to each other. With this actuation, a pilot line pressure of the four-port, two-position pilot-operated directional control valve 17 is decreased. At this time, the four-port, two-position pilot-operated directional control valve 17 is actuated so that the fluid passage 4*a* branched from the fluid passage 1*a* to which the port A at an original position is connected and the displacement pilot line (fluid passage 7*a*) of the hydraulic pump 31 at which the displacement is maximum (max) are connected to each other. Thus, the displacement from the hydraulic pump 31 is increased.

Next, with reference to FIG. 6, the actuation of the displacement switching at the time when the pressure of the hydraulic fluid is equal to or larger than the predetermined set value is described. When the pressure from the port A of the hydraulic pump 31 becomes higher than the set pressure of the sequence valve 16, the sequence valve 16 is switched so that the connection between the fluid passage 6*c* and the fluid passage 6*b* is canceled. Meanwhile, the fluid passage 6*a* which is branched from the fluid passage 4*a* and includes the restrictor and the fluid passage 6*b* connected to the four-port, two-position pilot-operated directional control valve 17 are connected to each other. With this actuation, a pressure is generated in the pilot line of the four-port, two-position pilot-operated directional control valve 17. This pilot pressure actuates the four-port, two-position pilot-operated directional control valve 17 so that the fluid passage 4*a* branched from the fluid passage 1*a* to which the port A is connected and the displacement pilot line (fluid passage 7*b*) of the hydraulic pump 31 at which the displacement is minimum (min) are connected to each other. Thus, the displacement from the hydraulic pump 31 is decreased.

As described above, provision of the displacement switching circuit of Example 3 allows the displacement of the hydraulic pump 31 to be controlled in accordance with the external load, thereby providing such an excellent effect that an operation can be performed under a state in which the load to the hydraulic pump 31 is suppressed.

Example 4

Figure 7:
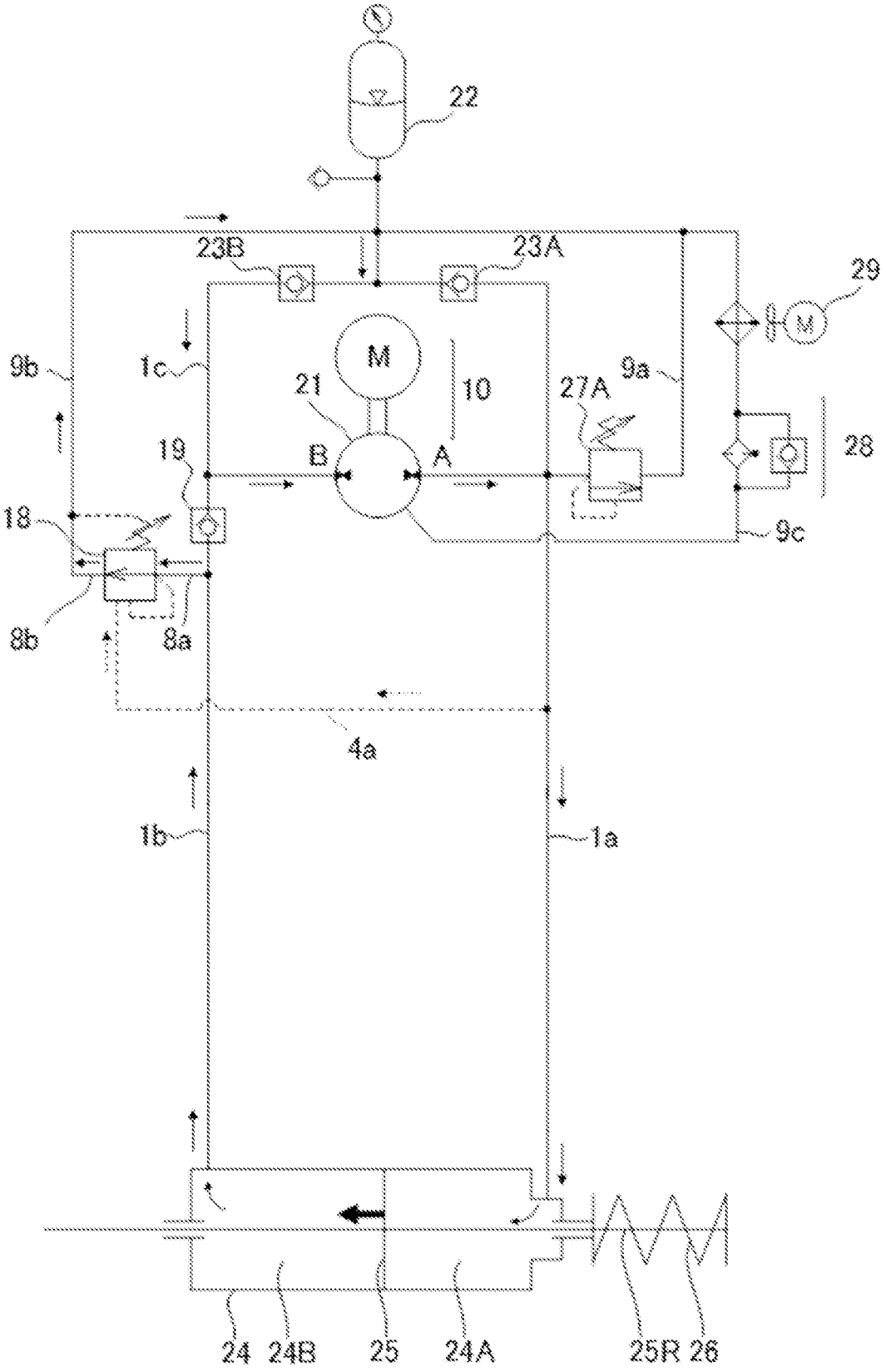
FIG. 7 is a hydraulic schematic for illustrating an actuation of hydraulic fluid cooling circulation at the time when a valve is opened as in Example 4 of the present invention.
Figure 8:
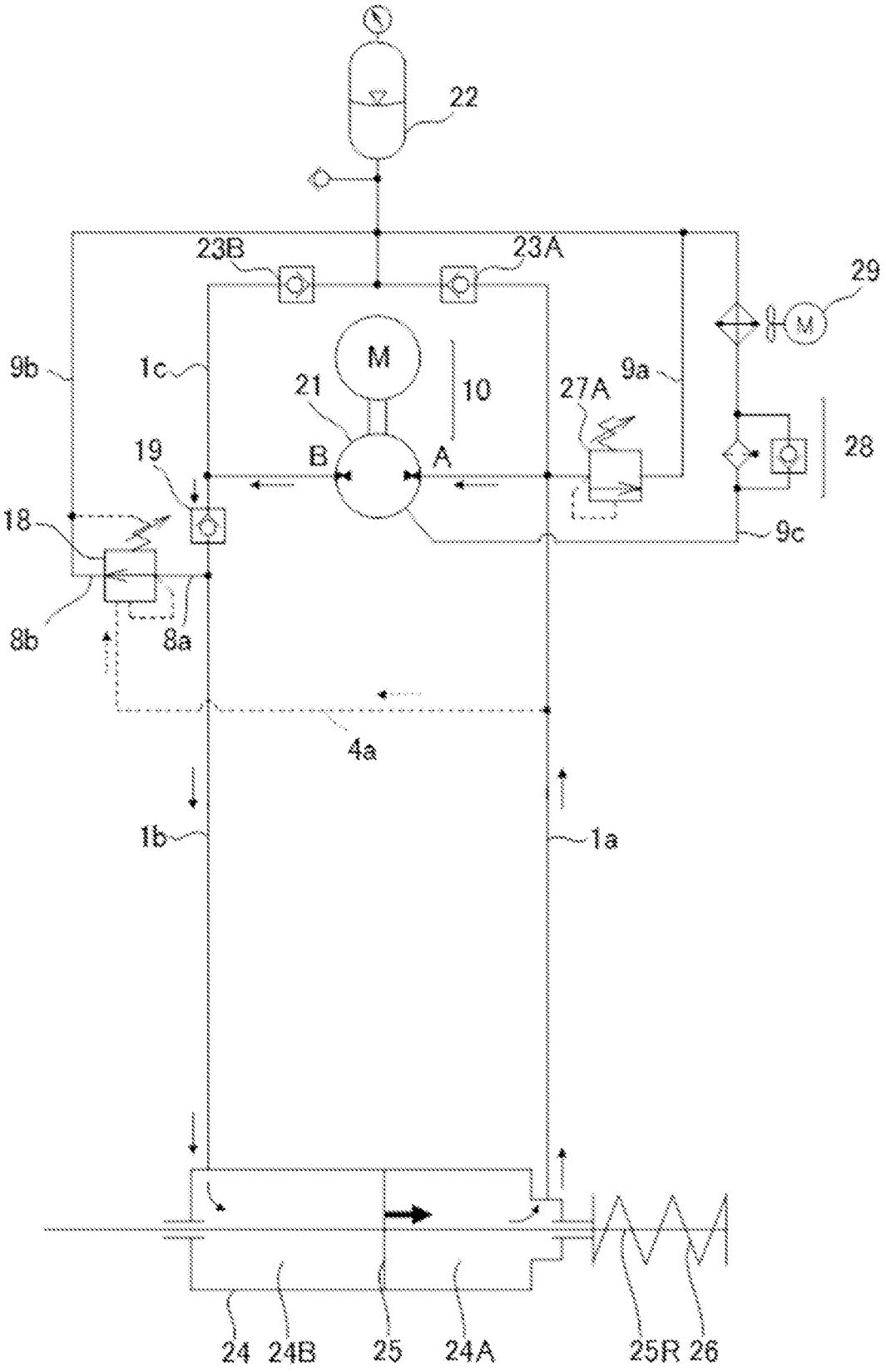
FIG. 8 is a hydraulic schematic for illustrating an actuation of the hydraulic fluid cooling circulation at the time when the valve is closed as in Example 4 of the present invention.

A hydraulic fluid cooling circulation circuit of Example 4 of the present invention is described. FIG. 7 is a hydraulic schematic for illustrating an actuation of hydraulic fluid cooling circulation at the time when the valve is opened in an electrohydrostatic actuation system of Example 4 of the present invention. FIG. 8 is a hydraulic schematic for illustrating an actuation of the hydraulic fluid cooling circulation at the time when the valve is closed in the electrohydrostatic actuation system of Example 4 of the present invention.

First, with reference to FIG. 7, the hydraulic fluid cooling circulation circuit is described. The hydraulic circuit includes a pilot-assisted open relief valve 18 (eighth valve) and a check valve 19 (ninth valve). The relief valve 27B is replaced with the pilot-assisted open relief valve 18, but the pilot-assisted open relief valve 18 also has the function implemented by the relief valve 27B (function of releasing the hydraulic fluid to the fluid passage 9*b* when the pressure of the hydraulic circuit exceeds the set pressure).

Next, a normal valve opening operation as in Example 4 is described. Originally, the entire hydraulic circuit is equally pressurized by the pressure accumulator 22 to a defined pressure which is, as an example, a pressure of about 0.5 MPa. The pressure is set here as 0.5 MPa, but the pressure can be set to any other pressure values. When the controller (not shown) outputs the command to open the steam valve, the pump/motor unit 10 discharges high-pressure hydraulic fluid from the port A of the hydraulic pump 21. The hydraulic fluid passes through the fluid passage 1*a*, and part thereof passes through the fluid passage 4*a* branched from the fluid passage 1*a* to be applied to the pilot-assisted open relief valve 18 as a pilot pressure. Then, the hydraulic fluid in the fluid passage 1*a* after the branch is supplied to the first chamber 24A of the hydraulic cylinder 24. At the time of the normal valve opening operation, the pressure controlled by the hydraulic pump 21 is lower than the set pressure of the relief valve 27A, and hence the relief valve 27A is kept closed.

The fluid passage 4*a*, a fluid passage 8*a*, and a fluid passage 8*b* are connected to the pilot-assisted open relief valve 18. The fluid passage 8*a* is connected to the fluid passage 1*b*. The fluid passage 8*b* is connected to the fluid passage 9*b*. During the steam valve opening operation, the pilot-assisted open relief valve 18 is brought into a valve open state by the pilot pressure from the port A supplied through the fluid passage 4*a* so that the fluid passage 8*a* (fluid passage 1*b*) and the fluid passage 8*b* (fluid passage 9*b*) are communicated to each other. The hydraulic fluid flowing from the second chamber 24B of the hydraulic cylinder 24 through the fluid passage 1*b* toward the port B is blocked by the check valve 19 provided on the downstream side (hydraulic cylinder 24 side) of the port B, and thus does not directly flow into the port B. However, the pilot-assisted open relief valve 18 is open, and hence the hydraulic fluid in the fluid passage 1*b* passes through the fluid passage 8*a*, the pilot-assisted open relief valve 18, and the fluid passage 8*b* to flow through the fluid passage 9*b* (drain line). Then, the hydraulic fluid flows through the fluid passage 9*b*, is mixed with the hydraulic fluid supplied from the pressure accumulator 22, passes through the check valve 23B for cavitation prevention, and is sucked through the port B of the hydraulic pump 21.

Next, with reference to FIG. 8, a normal valve closing operation of Example 4 is described. The valve closing operation is performed by means of control of the hydraulic pump 21 similar to that in Example 1, but the flow of the hydraulic fluid is partially different. The hydraulic pump 21 sucks the hydraulic fluid flowing from the first chamber 24A through the port A, and simultaneously discharges the hydraulic fluid through the port B. The hydraulic fluid flows to the fluid passage 1*b* via the check valve 19 provided on the downstream side of the port B. The pilot-assisted open relief valve 18 is maintained in the valve open state by the pilot pressure of the port A even at the time of the steam valve closing operation. Meanwhile, a pressure on an inlet side (fluid passage 8*a*) of the pilot-assisted open relief valve 18 is the same as a pressure on an outlet side (fluid passage 8*b*) thereof, and thus, even when the pilot-assisted open relief valve 18 is open, the hydraulic fluid does not flow through the pilot-assisted open relief valve 18. As a result, the hydraulic fluid flows through the fluid passage 1*b*, and is supplied to the second chamber 24B.

It is known from experiments performed so far that the temperature of the hydraulic fluid around the pressure accumulator 22 is generally lower than the hydraulic fluid temperature around the hydraulic pump 21. This is useful for keeping the temperature of the hydraulic fluid in the system to be low (keeping the hydraulic fluid to have an appropriate degree of viscosity) and ensuring an appropriate efficiency of the system.

As described above, provision of the hydraulic fluid cooling circulation circuit of Example 4, even under a state in which the circulation amount of the hydraulic fluid is small and thus the temperature is liable to rise, there is such an excellent effect that the viscosity or other performance of the hydraulic fluid can be prevented from being deteriorated.

Example 5

Figure 9:
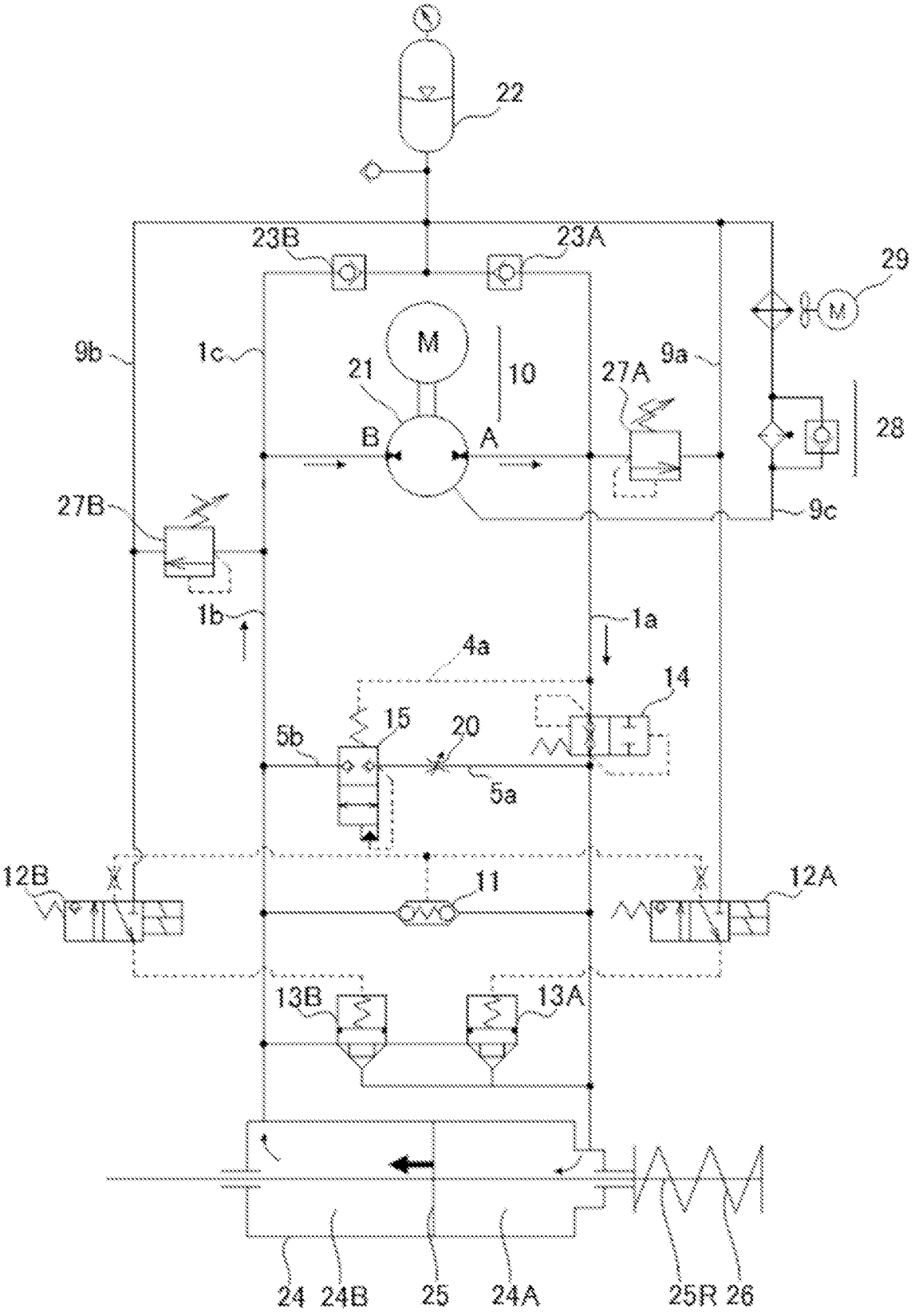
FIG. 9 is a hydraulic schematic of Example 5 of the present invention.

Example 5 of the present invention shows a configuration including the emergency shut-off circuit and the fail-safe shut-off and pump/motor unit protection circuit. That is, Example 5 includes the configurations of Examples 1 and 2 described above. FIG. 9 is a hydraulic schematic for illustrating an electrohydrostatic actuation system including an emergency shut-off circuit and a fail-safe shut-off and pump/motor unit protection circuit of Example 5 of the present invention. FIG. 9 shows a valve opening operation of Example 5.

In Example 5, the hydraulic circuit includes, in addition to the shuttle valve 11, the trip solenoid valve 12, and the logic valve 13 of Example 1, the fuse valve 14 and the logic valve 15. Supply of hydraulic fluid to those shuttle valve 11, trip solenoid valve 12, and logic valve 13 is similar to that in Example 1, and hence detailed description thereof is omitted. Further, the normal valve closing operation of Example 5 is also similar to that in Example 1, and hence detailed description thereof is omitted. Further, actuations of the fuse valve 14 and the logic valve 15 are similar to those in Example 2, and hence detailed description thereof is omitted.

At the time of fail-safe shut-off in which the pump/motor unit 10 loses electric power, the trip solenoid valve 12 is still energized, and the logic valve 13 is brought into a closed state by the pilot pressure via the shuttle valve 11. Accordingly, the hydraulic fluid does not flow through the logic valve 13.

As in Example 5, provision of the emergency shut-off circuit and the fail-safe shut-off and pump/motor unit protection circuit, allows to handle both of the emergency shut-off and the fail-safe shut-off. Further, there is provided such an excellent effect that, at the time of fail-safe shut-off, the hydraulic pump 21 can be protected from the hydraulic fluid refluxed to the hydraulic pump 21.

Example 6

Figure 10:
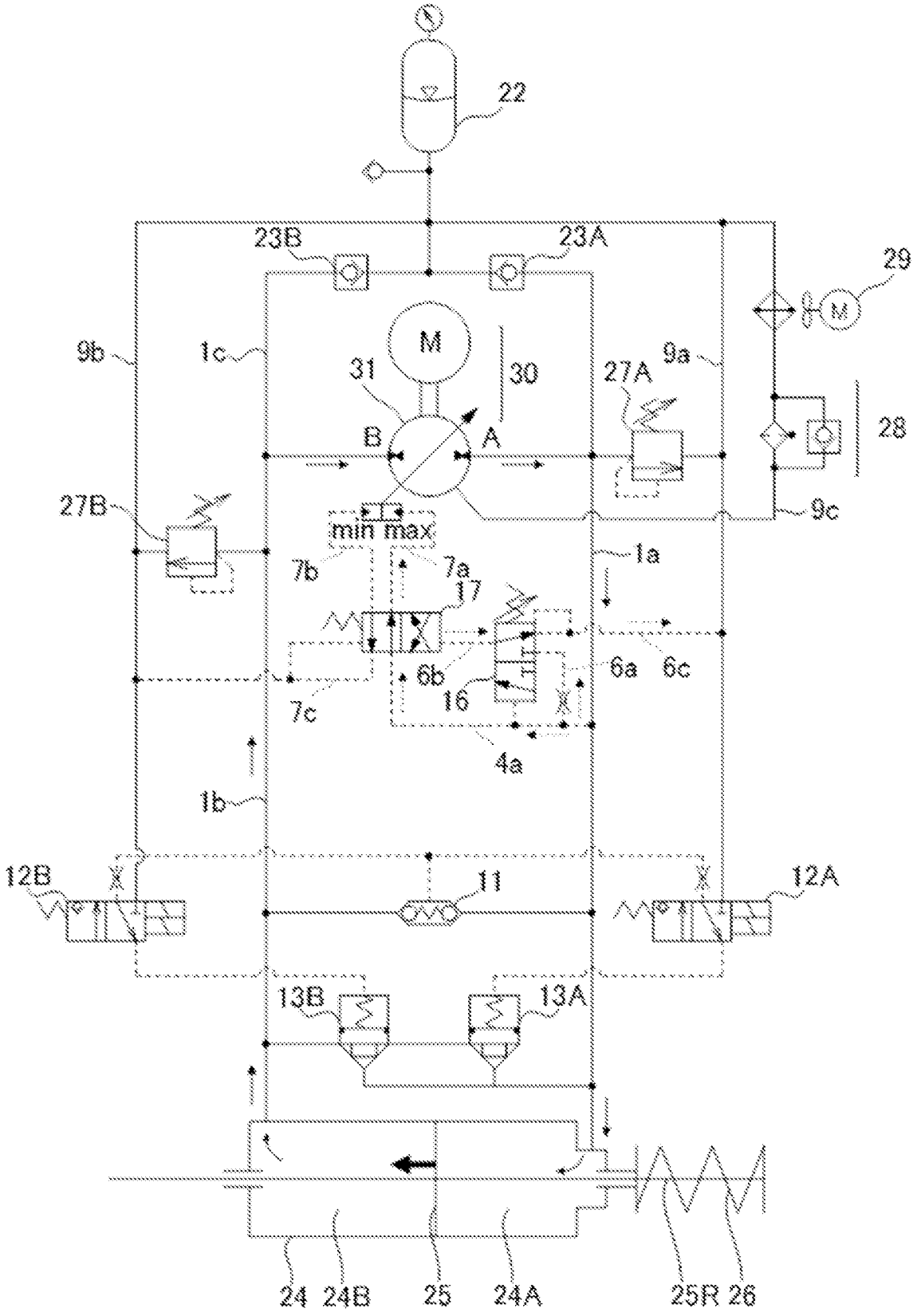
FIG. 10 is a hydraulic schematic of Example 6 of the present invention.

Example 6 of the present invention shows a configuration including the emergency shut-off circuit and the displacement switching circuit. That is, Example 6 includes the configurations of Examples 1 and 3 described above. FIG. 10 is a hydraulic schematic for illustrating an electrohydrostatic actuation system including an emergency shut-off circuit and a displacement switching circuit of Example 6 of the present invention. FIG. 10 is a hydraulic schematic for illustrating an actuation of displacement switching at the time when the pressure is smaller than a predetermined set value in the electrohydrostatic actuation system of Example 6.

In Example 6, the hydraulic circuit includes, in addition to the shuttle valve 11, the trip solenoid valve 12, and the logic valve 13 of Example 1, the sequence valve 16 and the four-port, two-position pilot-operated directional control valve 17. The hydraulic pump 31 is of a variable displacement type. Supply of hydraulic fluid to those shuttle valve 11, trip solenoid valve 12, and logic valve 13 is similar to that in Example 1, and hence detailed description thereof is omitted. Further, the normal valve closing operation of Example 6 is also similar to that in Example 1, and hence detailed description thereof is omitted. Further, actuations of the sequence valve 16 and the four-port, two-position pilot-operated directional control valve 17 are similar to those in Example 3, and hence detailed description thereof is omitted.

As in Example 6, provision of the emergency shut-off circuit and the displacement switching circuit allows to handle the emergency shut-off, and further, the displacement of the hydraulic pump 31 is controlled in accordance with the external load, thereby providing such an excellent effect that the operation can be performed under a case in which the load to the hydraulic pump 31 is suppressed.

Example 7

Figure 11:
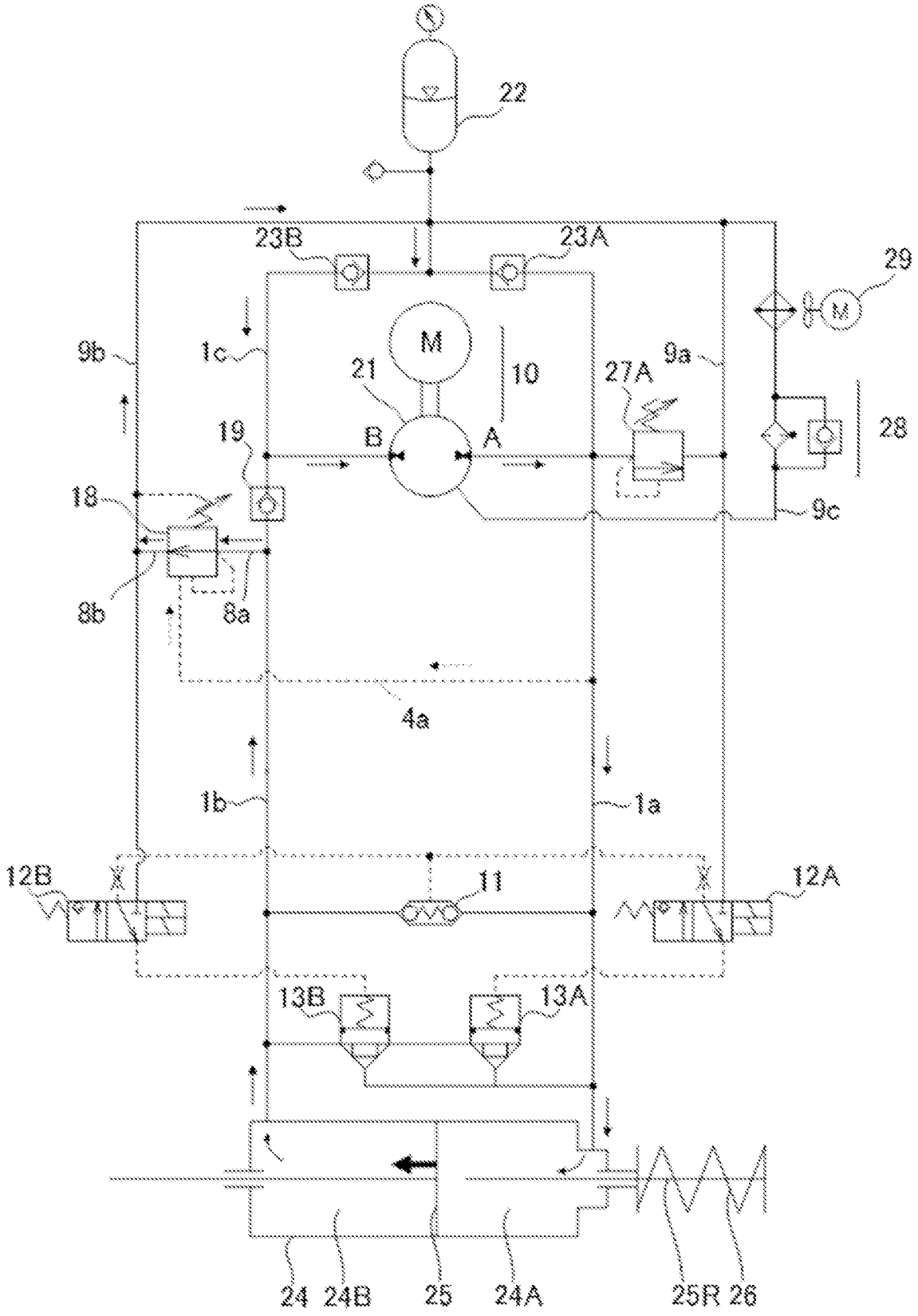
FIG. 11 is a hydraulic schematic of Example 7 of the present invention.

Example 7 of the present invention shows a configuration including the emergency shut-off circuit and the hydraulic fluid cooling circulation circuit. That is, Example 7 includes the configurations of Examples 1 and 4 described above. FIG. 11 is a hydraulic schematic for illustrating an electrohydrostatic actuation system including an emergency shut-off circuit and a hydraulic fluid cooling circulation circuit of Example 7 of the present invention. FIG. 11 is a hydraulic schematic for illustrating an actuation of hydraulic fluid cooling circulation at the time when the valve is opened in the electrohydrostatic actuation system of Example 7. The actuation of the hydraulic fluid cooling circulation at the time when the valve is closed in the electrohydrostatic actuation system of Example 7 is similar to that in Example 4, and hence detailed description thereof is omitted.

In Example 7, the hydraulic circuit includes, in addition to the shuttle valve 11, the trip solenoid valve 12, and the logic valve 13 of Example 1, the pilot-assisted open relief valve 18, and the check valve 19. Supply of hydraulic fluid to those shuttle valve 11, trip solenoid valve 12, and logic valve 13 is similar to that in Example 1, and hence detailed description thereof is omitted. Further, the normal valve closing operation of Example 7 is also similar to that in Example 1, and hence detailed description thereof is omitted. Further, actuations of the pilot-assisted open relief valve 18 and the check valve 19 are similar to those in Example 4, and hence detailed description thereof is omitted.

As in Example 7, provision of the emergency shut-off circuit and the hydraulic fluid cooling circulation circuit allows to handle the emergency shut-off, and further, there is provided such an excellent effect that, even under a state in which the circulation amount of the hydraulic fluid is small and thus the temperature is liable to rise, the viscosity or other performance of the hydraulic fluid can be prevented from being deteriorated.

Example 8

Figure 12:
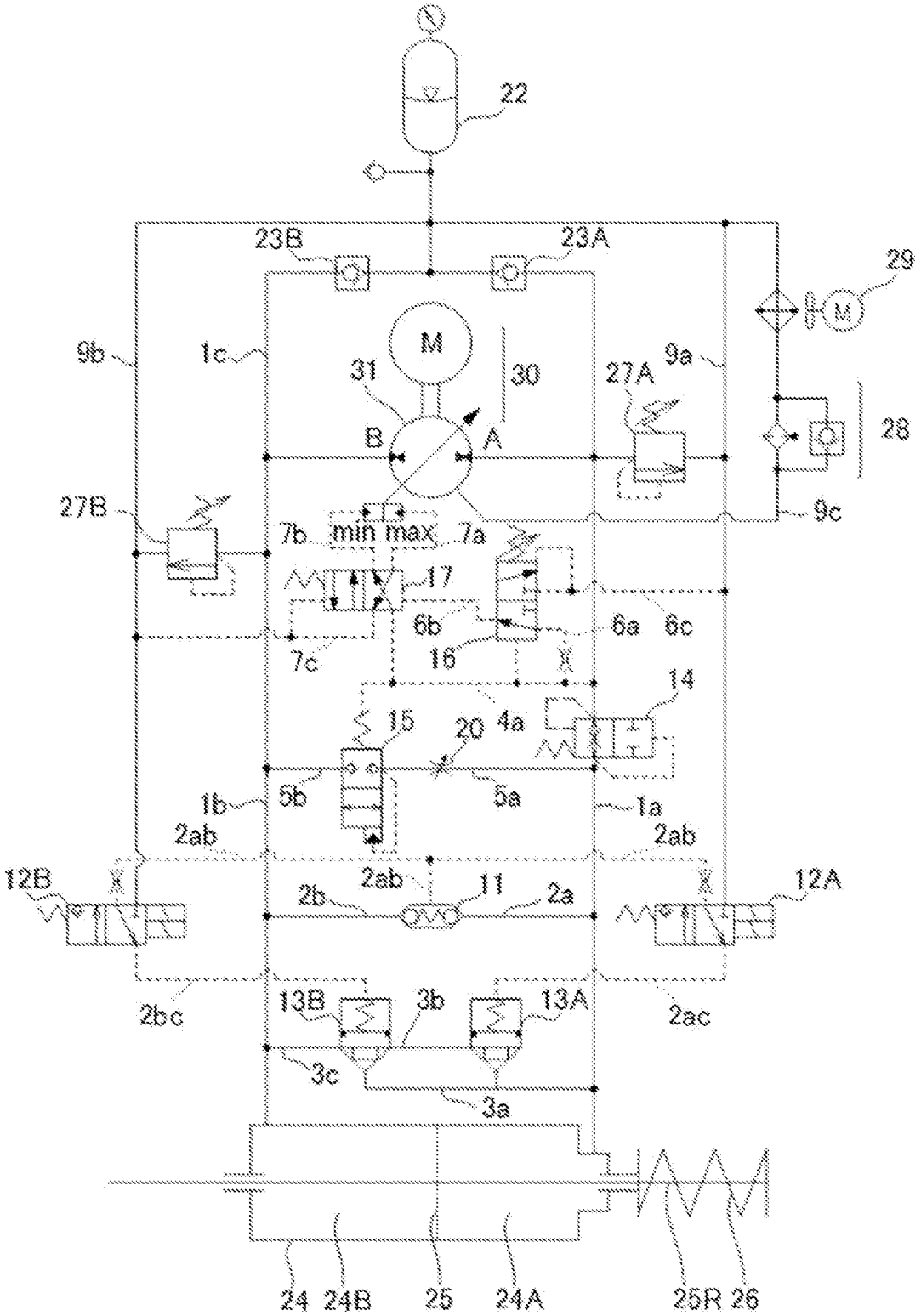
FIG. 12 is a hydraulic schematic of Example 8 of the present invention.

Example 8 of the present invention shows a configuration including an emergency shut-off circuit, a fail-safe shut-off circuit and pump/motor unit protection, and a displacement switching circuit. That is, Example 8 includes the configurations of Examples 1 to 3 described above. FIG. 12 is a hydraulic schematic for illustrating an electrohydrostatic actuation system including an emergency shut-off circuit, a fail-safe shut-off and pump/motor unit protection circuit, and a displacement switching circuit of Example 8 of the present invention. FIG. 12 is a hydraulic schematic for illustrating an actuation of displacement switching at the time when the pressure is equal to or larger than a predetermined set value in the electrohydrostatic actuation system of Example 8.

In Example 8, the hydraulic circuit includes, in addition to the shuttle valve 11, the trip solenoid valve 12, and the logic valve 13 of Example 1, the fuse valve 14, the logic valve 15, the sequence valve 16, and the four-port, two-position pilot-operated directional control valve 17. The hydraulic pump 31 is of a variable displacement type. Supply of hydraulic fluid to those shuttle valve 11, trip solenoid valve 12, and logic valve 13 is similar to that in Example 1, and hence detailed description thereof is omitted. Further, the normal valve closing operation of Example 8 is also similar to that in Example 1, and hence detailed description thereof is omitted. Further, actuations of the fuse valve 14 and the logic valve 15 are similar to those in Example 2, and actuations of the sequence valve 16 and the four-port, two-position pilot-operated directional control valve 17 are similar to those in Example 3. Thus, detailed description thereof is omitted.

As in Example 8, provision of the emergency shut-off circuit, the fail-safe shut-off and pump/motor unit protection circuit, and the displacement switching circuit allows to handle both of the emergency shut-off and the fail-safe shut-off. Further, at the time of fail-safe shut-off, the hydraulic pump 31 can be protected from the hydraulic fluid refluxed to the hydraulic pump 31. Further, the displacement of the hydraulic pump 31 is controlled in accordance with the external load, thereby providing such an excellent effect that the operation can be performed under a state in which the load to the hydraulic pump 31 is suppressed.

Example 9

Figure 13:
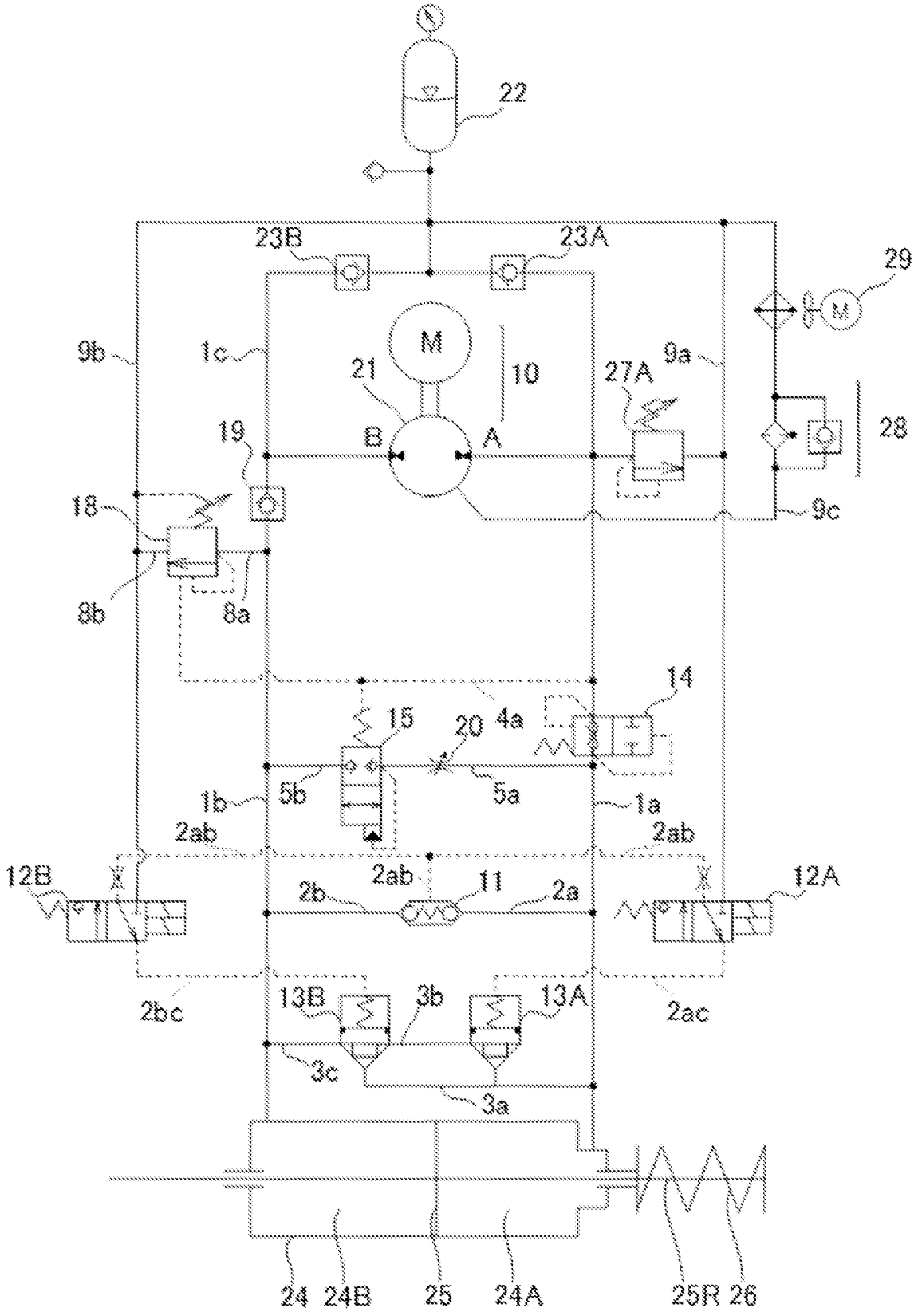
FIG. 13 is a hydraulic schematic of Example 9 of the present invention.

Example 9 of the present invention shows a configuration including an emergency shut-off circuit, a fail-safe shut-off and pump/motor unit protection circuit, and a hydraulic fluid cooling circulation circuit. That is, Example 9 includes the configurations of Examples 1, 2, and 4 described above. FIG. 13 is a hydraulic schematic for illustrating an electrohydrostatic actuation system including an emergency shut-off circuit, a fail-safe shut-off and pump/motor unit protection circuit, and a hydraulic fluid cooling circulation circuit of Example 9 of the present invention. FIG. 13 is a hydraulic schematic for illustrating an actuation of hydraulic fluid cooling circulation at the time when the valve is opened in the electrohydrostatic actuation system of Example 9. The actuation of the hydraulic fluid cooling circulation at the time when the valve is closed in the electrohydrostatic actuation system of Example 9 is similar to that in Example 4, and hence detailed description thereof is omitted.

In Example 9, the hydraulic circuit includes, in addition to the shuttle valve 11, the trip solenoid valve 12, and the logic valve 13 of Example 1, the fuse valve 14, the logic valve 15, the pilot-assisted open relief valve 18, and the check valve 19. Supply of hydraulic fluid to those shuttle valve 11, trip solenoid valve 12, and logic valve 13 is similar to that in Example 1, and hence detailed description thereof is omitted. Further, the normal valve closing operation of Example 9 is also similar to that in Example 1, and hence detailed description thereof is omitted. Further, actuations of the fuse valve 14 and the logic valve 15 are similar to those in Example 2, and actuations of the pilot-assisted open relief valve 18 and the check valve 19 are similar to those in Example 4. Thus, detailed description thereof is omitted.

As in Example 9, provision of the emergency shut-off circuit, the fail-safe shut-off circuit, and the hydraulic fluid cooling circulation circuit allows to handle both of the emergency shut-off and the fail-safe shut-off. Further, at the time of fail-safe shut-off, the hydraulic pump 21 can be protected from the hydraulic fluid refluxed to the hydraulic pump 21. Further, even under a state in which the circulation amount of the hydraulic fluid is small and thus the temperature is liable to rise, there is provided such an excellent effect that the viscosity or other performance of the hydraulic fluid can be prevented from being deteriorated.

Example 10

Figure 14:
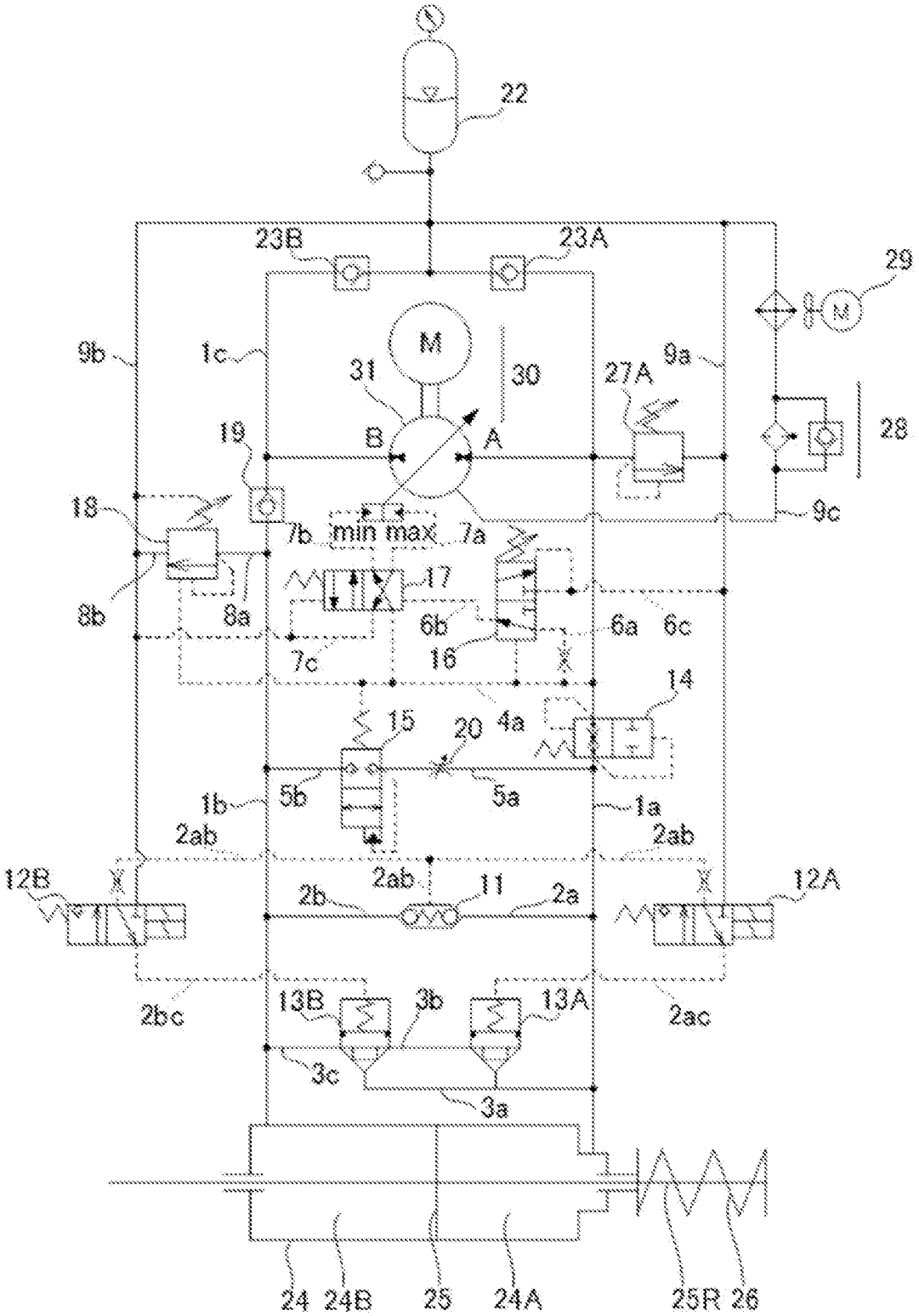
FIG. 14 is a hydraulic schematic of Example 10 of the present invention.

Example 10 of the present invention shows a configuration including the emergency shut-off circuit, the fail-safe shut-off and pump/motor unit protection circuit, the displacement switching circuit, and the hydraulic fluid cooling circulation circuit. That is, Example 10 includes the configurations of Examples 1 to 4 described above. FIG. 14 is a hydraulic schematic for illustrating an electrohydrostatic actuation system including an emergency shut-off circuit, a fail-safe shut-off and pump/motor unit protection circuit, a displacement switching circuit, and a hydraulic fluid cooling circulation circuit of Example 10 of the present invention. FIG. 14 is a hydraulic schematic for illustrating an actuation of the displacement switching at the time when the pressure at the time when the valve is opened is equal to or larger than a predetermined set value in the electrohydrostatic actuation system of Example 10.

In Example 10, the hydraulic circuit includes, in addition to the shuttle valve 11, the trip solenoid valve 12, and the logic valve 13 of Example 1, the fuse valve 14 and the logic valve 15 of Example 2. Further, the hydraulic circuit includes the sequence valve 16 and the four-port, two-position pilot-operated directional control valve 17 of Example 3, and the pilot-assisted open relief valve 18 and the check valve 19 of Example 4. The hydraulic pump 31 is of a variable displacement type. Supply of hydraulic fluid to those shuttle valve 11, trip solenoid valve 12, and logic valve 13 is similar to that in Example 1, and hence detailed description thereof is omitted. Further, the normal valve closing operation of Example 10 is also similar to that in Example 1, and hence detailed description thereof is omitted. Further, actuations of the fuse valve 14 and the logic valve 15 are similar to those in Example 2, and actuations of the sequence valve 16 and the four-port, two-position pilot-operated directional control valve 17 are similar to those in Example 3. Further, actuations of the pilot-assisted open relief valve 18 and the check valve 19 are similar to those in Example 4. Thus, detailed description thereof is omitted.

As in Example 10, provision of the emergency shut-off circuit, the fail-safe shut-off and pump/motor unit protection circuit, the displacement switching circuit, and the hydraulic fluid cooling circulation circuit allow to handle both of the emergency shut-off and the fail-safe shut-off. Further, at the time of fail-safe shut-off, the hydraulic pump 31 can be protected from the hydraulic fluid refluxed to the hydraulic pump 31. Further, the displacement of the hydraulic pump 31 is controlled in accordance with the external load, thereby being capable of performing the operation under a state in which the load to the hydraulic pump 31 is suppressed. Further, even under a state in which the circulation amount of the hydraulic fluid is small and thus the temperature is liable to rise, there is provided such an excellent effect that the viscosity or other performance of the hydraulic fluid can be prevented from being deteriorated.

Example 11

Figure 15:
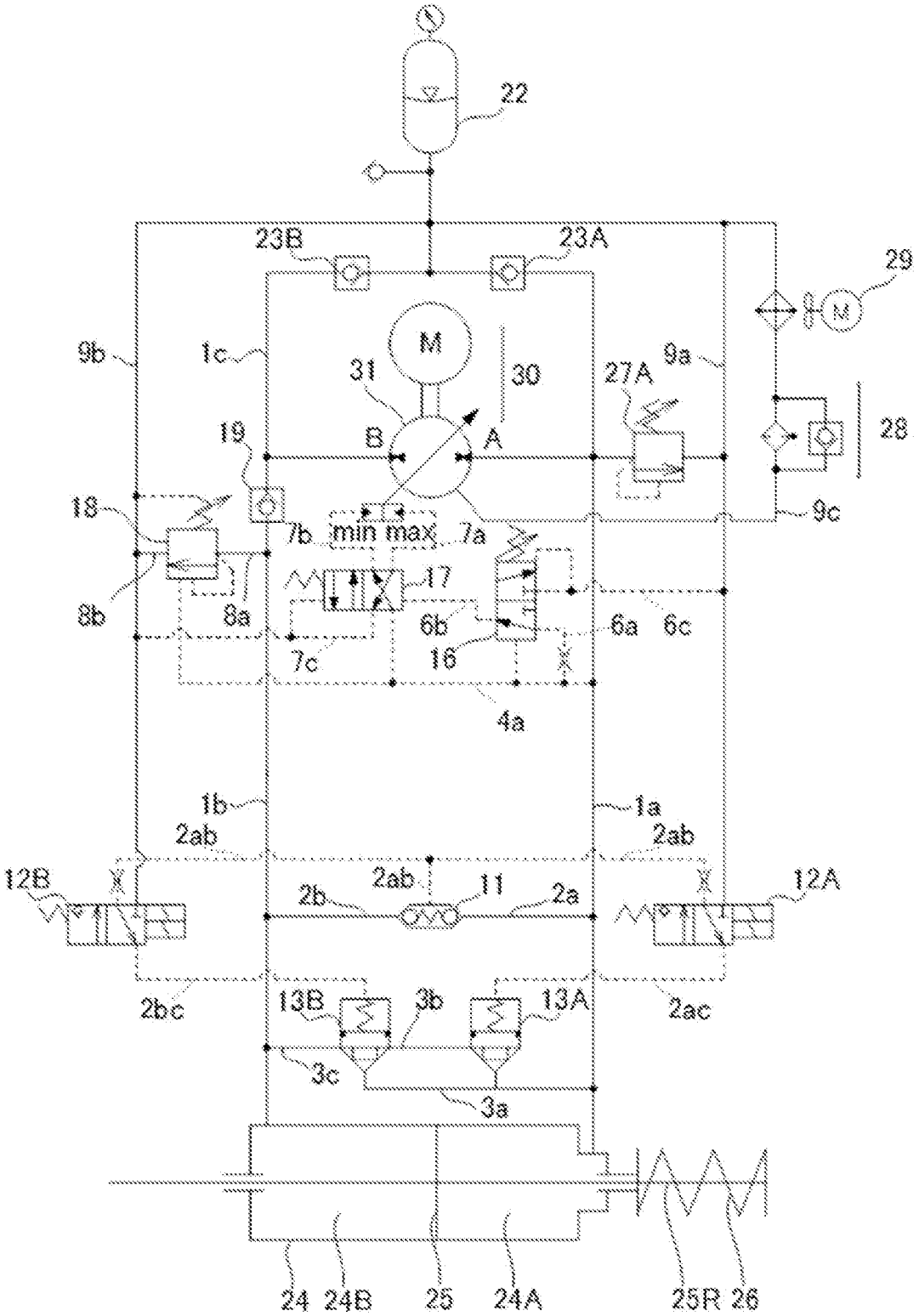
FIG. 15 is a hydraulic schematic of Example 11 of the present invention.

Example 11 of the present invention shows a configuration including the emergency shut-off circuit, the displacement switching circuit, and the hydraulic fluid cooling circulation circuit. That is, Example 11 includes the configurations of Examples 1, 3, and 4 described above. FIG. 15 is a hydraulic schematic for illustrating an electrohydrostatic actuation system including an emergency shut-off circuit, a displacement switching circuit, and a hydraulic fluid cooling circulation circuit of Example 11 of the present invention. FIG. 15 is a hydraulic schematic for illustrating an actuation of displacement switching at the time when the pressure at the time when the valve is opened is equal to or larger than a predetermined set value in the electrohydrostatic actuation system of Example 11.

In Example 11, the hydraulic circuit includes the shuttle valve 11, the trip solenoid valve 12, and the logic valve 13 of Example 1. Further, the hydraulic circuit includes the sequence valve 16 and the four-port, two-position pilot-operated directional control valve 17 of Example 3, and the pilot-assisted open relief valve 18 and the check valve 19 of Example 4. The hydraulic pump 31 is of a variable displacement type. Supply of hydraulic fluid to those shuttle valve 11, trip solenoid valve 12, and logic valve 13 is similar to that in Example 1, and hence detailed description thereof is omitted. Further, the normal valve closing operation of Example 11 is also similar to that in Example 1, and hence detailed description thereof is omitted. Further, actuations of the sequence valve 16 and the four-port, two-position pilot-operated directional control valve 17 are similar to those in Example 3. Further, actuations of the pilot-assisted open relief valve 18 and the check valve 19 are similar to those in Example 4. Thus, detailed description thereof is omitted.

As in Example 11, provision of the emergency shut-off circuit, the displacement switching circuit, and the hydraulic fluid cooling circulation circuit allows to handle the emergency shut-off. Further, the displacement of the hydraulic pump 31 is controlled in accordance with the external load, thereby being capable of performing the operation under a state in which the load to the hydraulic pump 31 is suppressed. Further, even under a state in which the circulation amount of the hydraulic fluid is small and thus the temperature is liable to rise, there is provided such an excellent effect that the viscosity or other performance of the hydraulic fluid can be prevented from being deteriorated.

Example 12

Figure 16:
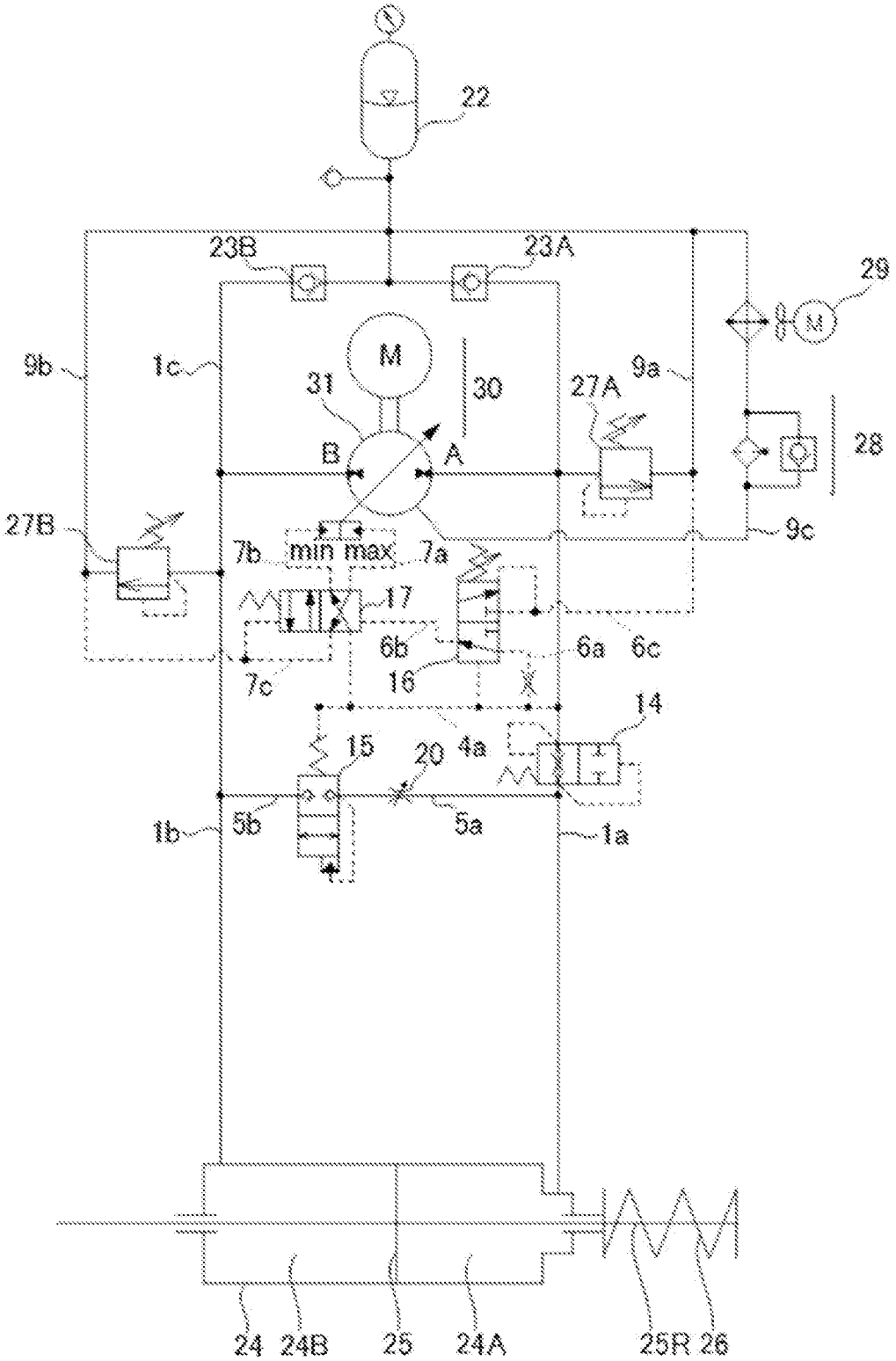
FIG. 16 is a hydraulic schematic of Example 12 of the present invention.

Example 12 of the present invention shows a configuration including the fail-safe shut-off and pump/motor unit protection circuit and the displacement switching circuit. That is, Example 12 includes the configurations of Examples 2 and 3 described above. FIG. 16 is a hydraulic schematic for illustrating an electrohydrostatic actuation system including a fail-safe shut-off and pump/motor unit protection circuit and a displacement switching circuit of Example 12 of the present invention. FIG. 16 is a hydraulic schematic for illustrating an actuation of displacement switching at the time when the pressure at the time when the valve is opened is equal to or larger than a predetermined set value in the electrohydrostatic actuation system of Example 12.

In Example 12, the hydraulic circuit includes the fuse valve 14 and the logic valve 15 in Example 2, and the sequence valve 16 and the four-port, two-position pilot-operated directional control valve 17 of Example 3. The hydraulic pump 31 is of a variable displacement type. Supply of hydraulic fluid to those fuse valve 14 and logic valve 15 is similar to that in Example 2, and hence detailed description thereof is omitted. Further, actuations of the sequence valve 16 and the four-port, two-position pilot-operated directional control valve 17 are similar to those in Example 3. Thus, detailed description thereof is omitted.

As in Example 12, provision of the fail-safe shut-off circuit and pump/motor unit protection and the displacement switching circuit allows to handle the fail-safe shut-off. Further, at the time of fail-safe shut-off, the hydraulic pump 31 can be protected from the hydraulic fluid refluxed to the hydraulic pump 31. Further, the displacement of the hydraulic pump 31 is controlled in accordance with the external load, thereby providing such an excellent effect that the operation can be performed under a state in which the load to the hydraulic pump 31 is suppressed.

Example 13

Figure 17:
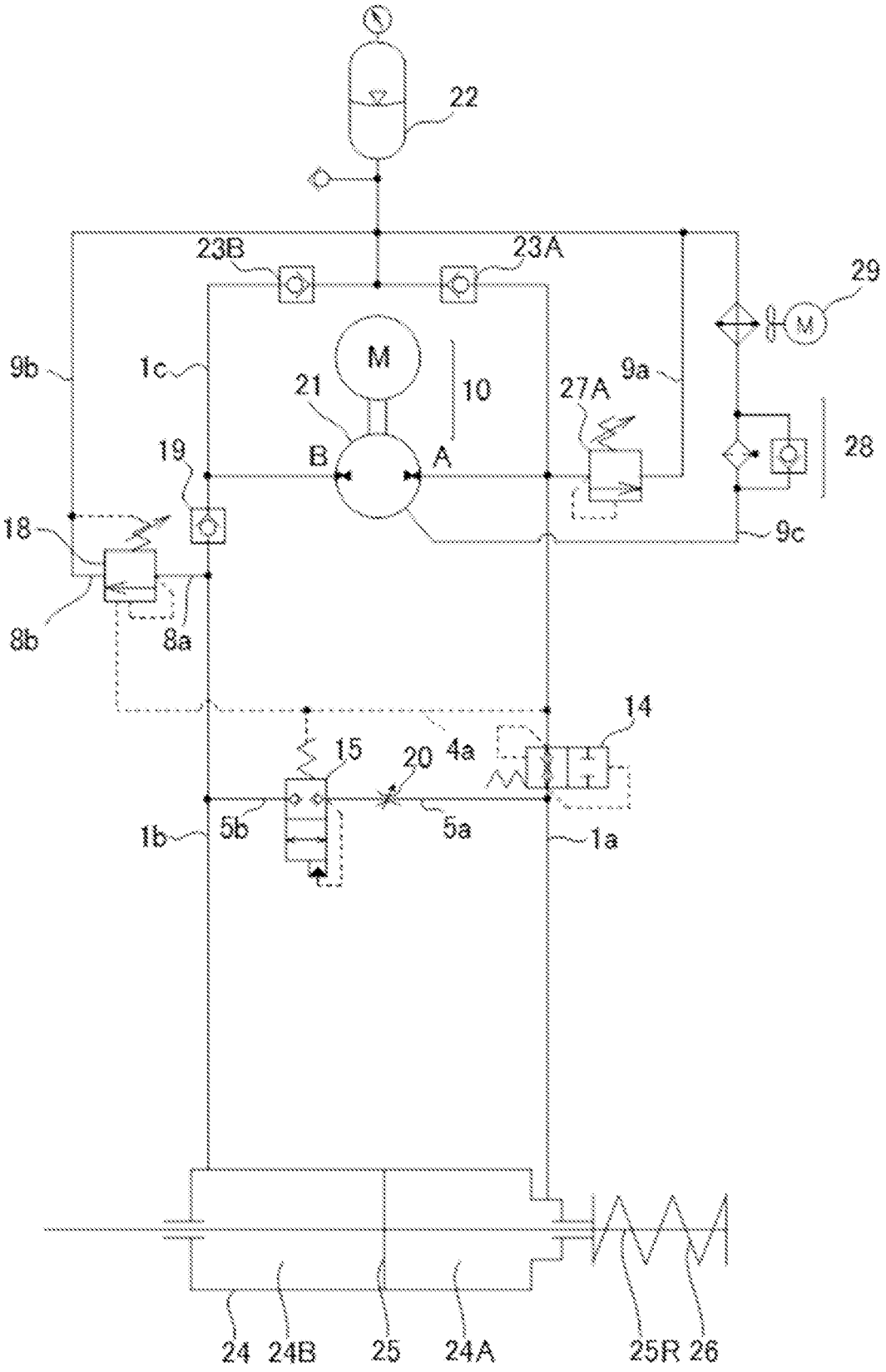
FIG. 17 is a hydraulic schematic of Example 13 of the present invention.

Example 13 of the present invention shows a configuration including the fail-safe shut-off and pump/motor unit protection circuit and the hydraulic fluid cooling circulation circuit. That is, Example 13 includes the configurations of Examples 2 and 4 described above. FIG. 17 is a hydraulic schematic for illustrating an electrohydrostatic actuation system including a fail-safe shut-off and pump/motor unit protection circuit and a hydraulic fluid cooling circulation circuit of Example 13 of the present invention. FIG. 17 is a hydraulic schematic for illustrating an actuation of hydraulic fluid cooling circulation at the time when the valve is opened in the electrohydrostatic actuation system of Example 13. The actuation of the hydraulic fluid cooling circulation at the time when the valve is closed in the electrohydrostatic actuation system of Example 13 is similar to that in Example 4, and hence detailed description thereof is omitted.

In Example 13, the hydraulic circuit includes the fuse valve 14 and the logic valve 15 of Example 2, and the pilot-assisted open relief valve 18 and the check valve 19. Actuations of the fuse valve 14 and the logic valve 15 are similar to those in Example 2. Further, actuations of the pilot-assisted open relief valve 18 and the check valve 19 are similar to those in Example 4. Thus, detailed description thereof is omitted.

As in Example 13, provision of the fail-safe shut-off and pump/motor unit protection circuit and the hydraulic fluid cooling circulation circuit allows to handle the fail-safe shut-off. Further, at the time of fail-safe shut-off, the hydraulic pump 21 can be protected from the hydraulic fluid refluxed to the hydraulic pump 21. Further, even under a state in which the circulation amount of the hydraulic fluid is small and thus the temperature is liable to rise, there is provided such an excellent effect that the viscosity or other performance of the hydraulic fluid can be prevented from being deteriorated.

Example 14

Figure 18:
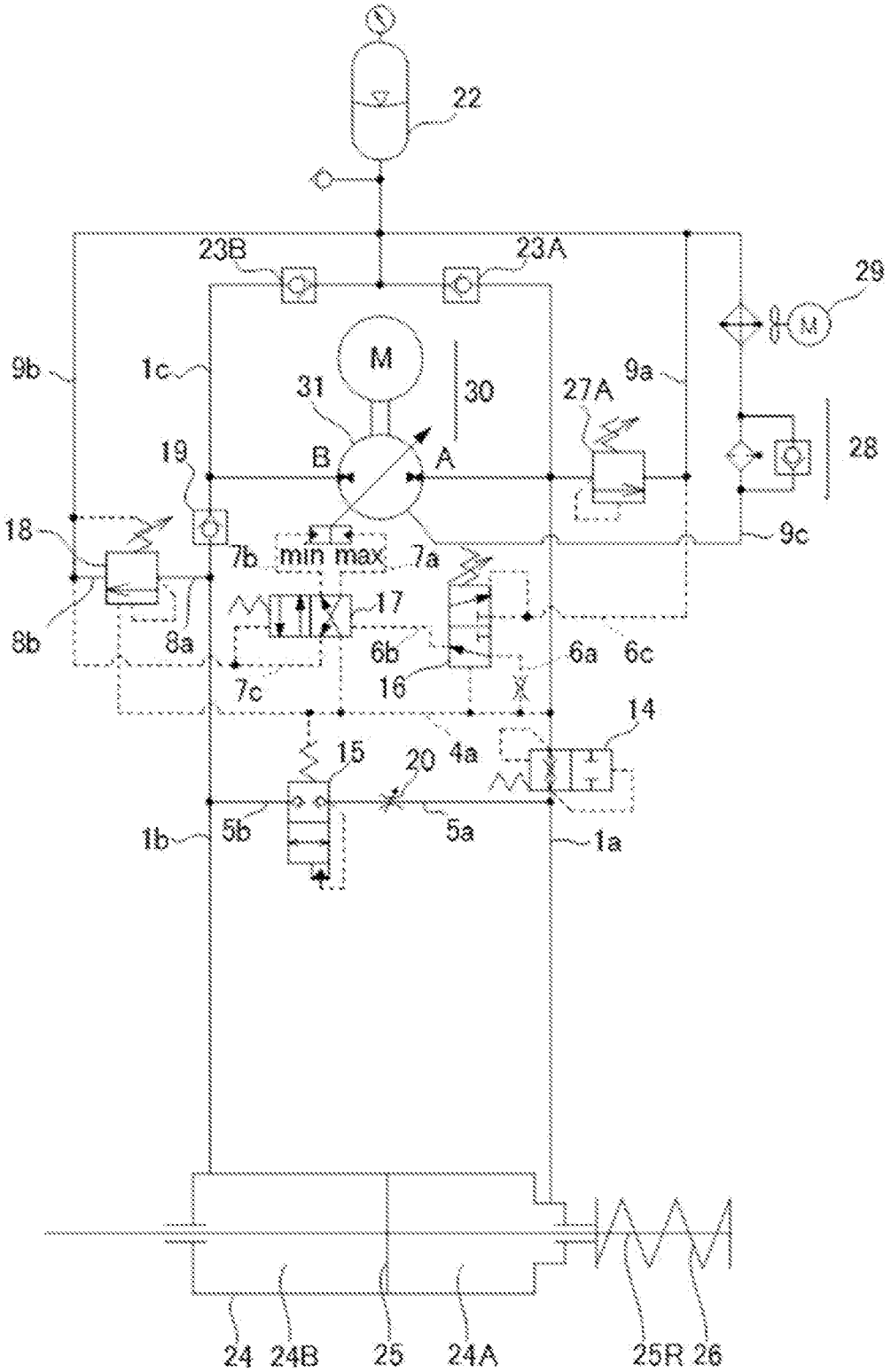
FIG. 18 is a hydraulic schematic of Example 14 of the present invention.

Example 14 of the present invention shows a configuration including the fail-safe shut-off and pump/motor unit protection circuit, the displacement switching circuit, and the hydraulic fluid cooling circulation circuit. That is, Example 14 includes the configurations of Examples 2 to 4 described above. FIG. 18 is a hydraulic schematic for illustrating an electrohydrostatic actuation system including a fail-safe shut-off and pump/motor unit protection circuit, a displacement switching circuit, and a hydraulic fluid cooling circulation circuit of Example 14 of the present invention. FIG. 18 is a hydraulic schematic for illustrating an actuation of displacement switching at the time when the pressure at the time when the valve is opened is equal to or larger than a predetermined set value in the electrohydrostatic actuation system of Example 14.

In Example 14, the hydraulic circuit includes the fuse valve 14 and the logic valve 15 of Example 3, the sequence valve 16 and the four-port, two-position pilot-operated directional control valve 17 of Example 3, and the pilot-assisted open relief valve 18 and the check valve 19 of Example 4. The hydraulic pump 31 is of a variable displacement type. Actuations of the fuse valve 14 and the logic valve 15 are similar to those in Example 2, and actuations of the sequence valve 16 and the four-port, two-position pilot-operated directional control valve 17 are similar to those in Example 3. Further, actuations of the pilot-assisted open relief valve 18 and the check valve 19 are similar to those in Example 4. Thus, detailed description thereof is omitted.

As in Example 14, provision of the fail-safe shut-off and pump/motor unit protection circuit, the displacement switching circuit, and the hydraulic fluid cooling circulation circuit allows to handle the fail-safe shut-off. Further, at the time of fail-safe shut-off, the hydraulic pump 31 can be protected from the hydraulic fluid refluxed to the hydraulic pump 31. Further, the displacement of the hydraulic pump 31 is controlled in accordance with the external load, thereby being capable of performing the operation under a state in which the load to the hydraulic pump 31 is suppressed. Further, even under a state in which the circulation amount of the hydraulic fluid is small and thus the temperature is liable to rise, there is provided such an excellent effect that the viscosity or other performance of the hydraulic fluid can be prevented from being deteriorated.

Example 15

Figure 19:
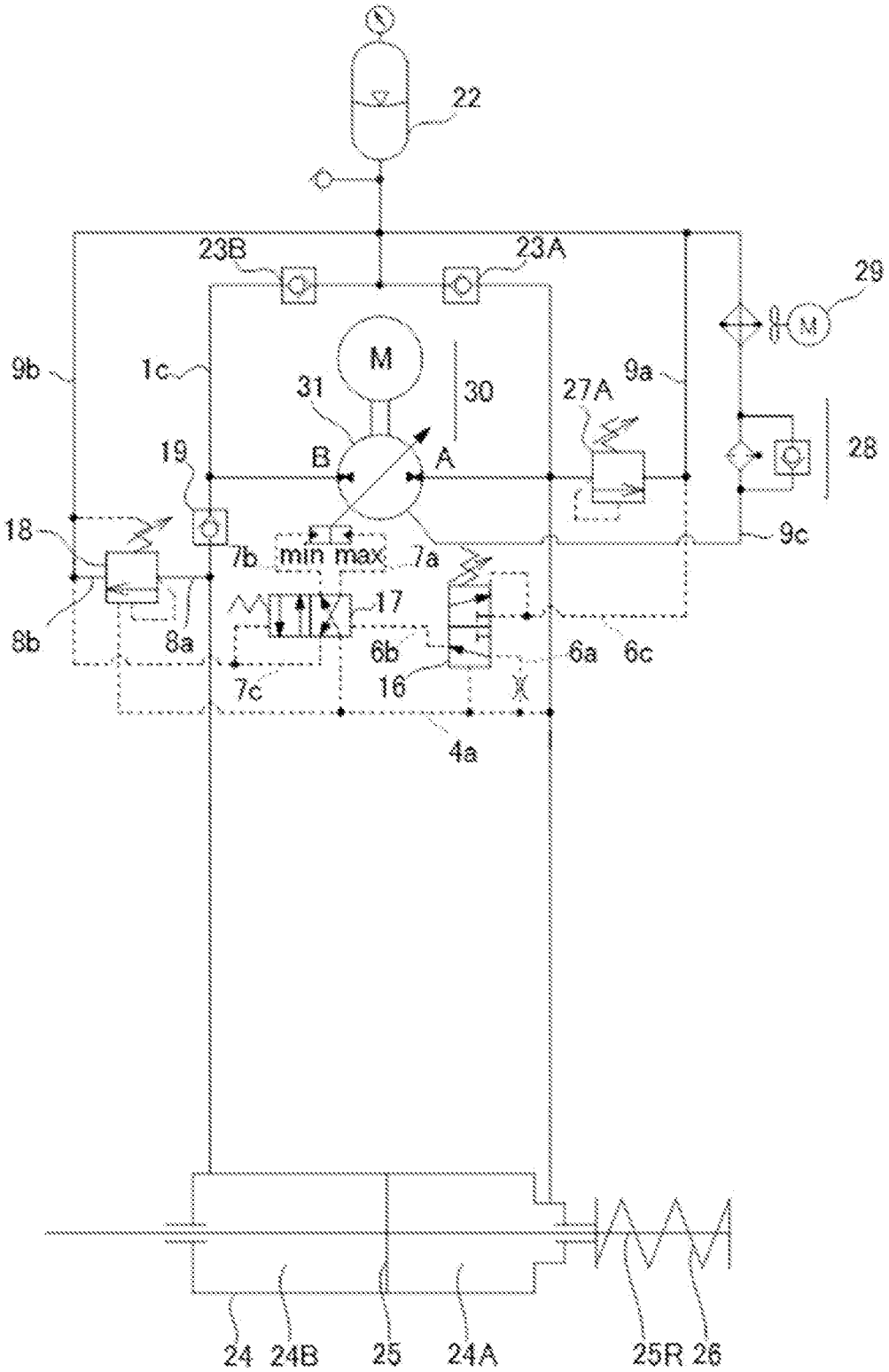
FIG. 19 is a hydraulic schematic of Example 15 of the present invention.

Example 15 of the present invention shows a configuration including the displacement switching circuit and the hydraulic fluid cooling circulation circuit. That is, Example 15 includes the configurations of Examples 3 and 4 described above. FIG. 19 is a hydraulic schematic for illustrating an electrohydrostatic actuation system including a displacement switching circuit and a hydraulic fluid cooling circulation circuit of Example 15 of the present invention. FIG. 19 is a hydraulic schematic for illustrating an actuation of displacement switching at the time when the pressure at the time when the valve is opened is equal to or larger than a predetermined set value in the electrohydrostatic actuation system of Example 15.

In Example 15, the hydraulic circuit includes the sequence valve 16 and the four-port, two-position pilot-operated directional control valve 17 of Example 3, and the pilot-assisted open relief valve 18 and the check valve 19 of Example 4. The hydraulic pump 31 is of a variable displacement type. Actuations of the sequence valve 16 and the four-port, two-position pilot-operated directional control valve 17 are similar to those in Example 3. Further, actuations of the pilot-assisted open relief valve 18 and the check valve 19 are similar to those in Example 4. Thus, detailed description thereof is omitted.

As in Example 15, provision of the displacement switching circuit and the hydraulic fluid cooling circulation circuit allows to control the displacement of the hydraulic pump 31 in accordance with the external load, thereby being capable of performing the operation under a state in which the load to the hydraulic pump 31 is suppressed. Further, even under a state in which the circulation amount of the hydraulic fluid is small and thus the temperature is liable to rise, there is provided such an excellent effect that the viscosity or other performance of the hydraulic fluid can be prevented from being deteriorated.

Preferred Examples 1 to 15 of the present invention are described above, but the present invention is not limited to those Examples and can be modified and changed variously within the scope of the gist thereof.

This application claims the benefit of priority from Japanese Patent Application No. 2019-167187, filed on Sep. 13, 2019, the content of which is incorporated herein by reference.

REFERENCE SIGNS LIST

1*a* fluid passage
9*b* fluid passage (drain line)
11 shuttle valve (first valve)
12, 12A, 12B solenoid valve (second valve)
13, 13A, 13B logic valve (third valve)
14 fuse valve (fourth valve)
15 logic valve (fifth valve, second logic valve)
16 sequence valve (sixth valve)
17 four-port, two-position pilot-operated directional control valve (seventh valve)
18 pilot-assisted open relief valve (eighth valve)
19 check valve (nineth valve)
21, 31 hydraulic pump
24 hydraulic cylinder
24A first chamber
24B second chamber
25 piston
26 return spring
29 radiator and cooling fan (active cooling circuit)
A discharge port
M servo motor (electric motor)

The invention claimed is:

1. An electrohydrostatic actuation system comprising:
a hydraulic cylinder including:
a piston to which a valve element biased by a return spring is connected;
a first chamber; and
a second chamber;
a hydraulic pump configured to supply hydraulic fluid to the first chamber or the second chamber;
an electric motor configured to drive the hydraulic pump;
a shuttle valve configured to establish communication to a downstream side under a state in which a hydraulic pressure generated by the hydraulic pump is maintained, the hydraulic fluid having a higher pressure in pressures of the hydraulic fluid to be supplied;
a solenoid valve configured to receive the hydraulic pressure via the shuttle valve as a pilot pressure; and
a logic valve including:
a first port configured to receive the pilot pressure from the solenoid valve; and
a second port communicated to the first chamber of the hydraulic cylinder,
wherein, when the solenoid valve is brought to a de-energized state, the pilot pressure of the logic valve is released, and the logic valve causes the hydraulic fluid in the first chamber communicated to the second port to flow into the second chamber so that emergency shut-off of the valve element is achieved by the return spring.

2. The electrohydrostatic actuation system according to claim 1, further comprising:
a use valve provided in a fluid passage communicating between the hydraulic pump and the first chamber of the hydraulic cylinder; and
a second logic valve,
wherein, when the electric motor loses electric power, and a flow rate of the hydraulic fluid in the fluid passage returning from the hydraulic cylinder to the hydraulic pump exceeds a predetermined value, the use valve blocks a flow of the hydraulic fluid in the fluid passage, and
wherein the second logic valve is configured to connect a circuit so as to cause the blocked hydraulic fluid to return to the second chamber of the hydraulic cylinder so that fail-safe shut-off of the valve element is achieved to protect the hydraulic pump.

3. The electrohydrostatic actuation system according to claim 2, further comprising:
a sequence valve; and
a four-port, two-position pilot-operated directional control valve,
wherein, when a pressure of the hydraulic fluid discharged from the hydraulic pump becomes lower than a predetermined set value, the sequence valve reduces a pilot pressure to be applied to the four-port, two-position pilot-operated directional control valve, and the four-port, two-position pilot-operated directional control valve connects between a discharge port of the hydraulic pump and a pilot line of the hydraulic pump at which a displacement of the hydraulic pump is maximum, and
wherein, when the pressure of the hydraulic fluid discharged from the hydraulic pump exceeds the predetermined set value, the sequence valve increases the pilot pressure to be applied to the four-port, two-position pilot-operated directional control valve, and the four-port, two-position pilot-operated directional control valve connects between the discharge port of the hydraulic pump and a pilot line of the hydraulic pump at which the displacement of the hydraulic pump is minimum so that a displacement of the hydraulic pump is controlled.

4. The electrohydrostatic actuation system according to claim 3, further comprising:
a pilot-assisted open relief valve; and
a check valve,
wherein, in an operation of opening the valve element, the hydraulic fluid from the second chamber is blocked by the check valve, and the pilot-assisted open relief valve receives a pilot pressure by a pressure of the hydraulic fluid and is thus opened so that the hydraulic fluid from the second chamber flows through a drain line via the pilot-assisted open relief valve so as to be cooled, and
wherein, in an operation of closing the valve element, the hydraulic fluid is supplied to the second chamber via the check valve.

5. The electrohydrostatic actuation system according to claim 2, further comprising:
a pilot-assisted open relief valve; and
a check valve,
wherein, in an operation of opening the valve element, the hydraulic fluid from the second chamber is blocked by the check valve, and the pilot-assisted open relief valve receives a pilot pressure by a pressure of the hydraulic fluid and is thus opened so that the hydraulic fluid from the second chamber flows through a drain line via the pilot-assisted open relief valve so as to be cooled, and
wherein, in an operation of closing the valve element, the hydraulic fluid is supplied to the second chamber via the check valve.

6. The electrohydrostatic actuation system according to claim 1, further comprising:
a sequence valve; and
a four-port, two-position pilot-operated directional control valve,
wherein, when a pressure of the hydraulic fluid discharged from the hydraulic pump becomes lower than a predetermined set value, the sequence valve reduces a pilot pressure to be applied to the four-port, two-position pilot-operated directional control valve, and the four-port, two-position pilot-operated directional control valve connects between a discharge port of the hydraulic pump and a pilot line of the hydraulic pump at which a displacement of the hydraulic pump is maximum, and
wherein, when the pressure of the hydraulic fluid discharged from the hydraulic pump exceeds the predetermined set value, the sequence valve increases the pilot pressure to be applied to the four-port, two-position pilot-operated directional control valve, and the four-port, two-position pilot-operated directional control valve connects between the discharge port of the hydraulic pump and a pilot line of the hydraulic pump at which the displacement of the hydraulic pump is minimum so that a displacement of the hydraulic pump is controlled.

7. The electrohydrostatic actuation system according to claim 6, further comprising:
a pilot-assisted open relief valve; and
a check valve,
wherein, in an operation of opening the valve element, the hydraulic fluid from the second chamber is blocked by the check valve, and the pilot-assisted open relief valve receives a pilot pressure by a pressure of the hydraulic fluid and is thus opened so that the hydraulic fluid from the second chamber flows through a drain line via the pilot-assisted open relief valve so as to be cooled, and wherein, in an operation of closing the valve element, the hydraulic fluid is supplied to the second chamber via the check valve.

8. The electrohydrostatic actuation system according to claim 1, further comprising:

a pilot-assisted open relief valve; and a check valve, wherein, in an operation of opening the valve element, the hydraulic fluid from the second chamber is blocked by the check valve, and the pilot-assisted open relief valve receives a pilot pressure by a pressure of the hydraulic fluid and is thus opened so that the hydraulic fluid from the second chamber flows through a drain line via the pilot-assisted open relief valve so as to be cooled, and wherein, in an operation of closing the valve element, the hydraulic fluid is supplied to the second chamber via the check valve.

9. An electrohydrostatic actuation system comprising:

a hydraulic cylinder including:

a piston to which a valve element biased by a return spring is connected;

a first chamber; and a second chamber;

a hydraulic pump configured to supply hydraulic fluid to the first chamber or the second chamber, or to collect the hydraulic fluid from the first chamber or the second chamber;

an electric motor configured to drive the hydraulic pump;

a fuse valve provided in a fluid passage communicating between the hydraulic pump and the first chamber of the hydraulic cylinder; and a logic valve, wherein, when the electric motor loses electric power, and a flow rate of the hydraulic fluid in the fluid passage returning from the hydraulic cylinder to the hydraulic pump exceeds a predetermined value, the fuse valve blocks a flow of the hydraulic fluid in the fluid passage, and wherein the logic valve is configured to connect a circuit so as to cause the blocked hydraulic fluid to return to the second chamber of the hydraulic cylinder so that fail-safe shut-off of the valve element is achieved to protect the hydraulic pump.

10. The electrohydrostatic actuation system according to claim 9, further comprising:

a sequence valve; and a four-port, two-position pilot-operated directional control valve, wherein, when a pressure of the hydraulic fluid discharged from the hydraulic pump becomes lower than a predetermined set value, the sequence valve reduces a pilot pressure to be applied to the four-port, two-position pilot-operated directional control valve, and the four-port, two-position pilot-operated directional control valve connects between a discharge port of the hydraulic pump and a pilot line of the hydraulic pump at which a displacement of the hydraulic pump is maximum, and wherein, when the pressure of the hydraulic fluid discharged from the hydraulic pump exceeds the predetermined set value, the sequence valve increases the pilot pressure to be applied to the four-port, two-position pilot-operated directional control valve, and the four-port, two-position pilot-operated directional control valve connects between the discharge port of the hydraulic pump and a pilot line of the hydraulic pump at which the displacement of the hydraulic pump is minimum so that a displacement of the hydraulic pump is controlled.

11. The electrohydrostatic actuation system according to claim 10, further comprising:

a check valve; and a pilot-assisted open relief valve, wherein, in an operation of opening the valve element, the hydraulic fluid from the second chamber is blocked by the check valve, and the pilot-assisted open relief valve receives a pilot pressure by a pressure of the hydraulic fluid and is thus opened so that the hydraulic fluid from the second chamber flows through a drain line via the pilot-assisted open relief valve so as to be cooled, and wherein, in an operation of closing the valve element, the pilot-assisted open relief valve maintains a valve open state because the pilot pressure is maintained, and the hydraulic fluid is supplied to the second chamber via the check valve.

12. The electrohydrostatic actuation system according to claim 9, further comprising:

a check valve; and a pilot-assisted open relief valve, wherein, in an operation of opening the valve element, the hydraulic fluid from the second chamber is blocked by the check valve, and the pilot-assisted open relief valve receives a pilot pressure by a pressure of the hydraulic fluid and is thus opened so that the hydraulic fluid from the second chamber flows through a drain line via the pilot-assisted open relief valve so as to be cooled, and wherein, in an operation of closing the valve element, the pilot-assisted open relief valve maintains a valve open state because the pilot pressure is maintained, and the hydraulic fluid is supplied to the second chamber via the check valve.

13. An electrohydrostatic actuation system comprising:

a hydraulic cylinder including:

a piston to which a valve element biased by a return spring is connected;

a first chamber; and a second chamber;

a hydraulic pump configured to supply hydraulic fluid to the first chamber or the second chamber, or to collect the hydraulic fluid from the first chamber or the second chamber;

an electric motor configured to drive the hydraulic pump;

a sequence valve; and a four-port, two-position pilot-operated directional control valve, wherein, when a pressure of the hydraulic fluid discharged from the hydraulic pump becomes lower than a predetermined set value, the sequence valve reduces a pilot pressure to be applied to the four-port, two-position pilot-operated directional control valve, and the four-port, two-position pilot-operated directional control valve connects between a discharge port of the hydraulic pump and a pilot line of the hydraulic pump at which a displacement of the hydraulic pump is maximum, and wherein, when the pressure of the hydraulic fluid discharged from the hydraulic pump exceeds the predetermined set value, the sequence valve increases the pilot pressure to be applied to the four-port, two-position pilot-operated directional control valve, and the four-port, two-position pilot-operated directional control valve connects between the discharge port of the hydraulic pump and a pilot line of the hydraulic pump at which the displacement of the hydraulic pump is minimum so that a displacement of the hydraulic pump is controlled.

14. The electrohydrostatic actuation system according to claim 13, further comprising:

a check valve; and a pilot-assisted open relief valve, wherein, in an operation of opening the valve element, the hydraulic fluid from the second chamber is blocked by the check valve, and the pilot-assisted open relief valve receives a pilot pressure by a pressure of the hydraulic fluid and is thus opened so that the hydraulic fluid from the second chamber flows through a drain line via the pilot-assisted open relief valve so as to be cooled, and wherein, in an operation of closing the valve element, the pilot-assisted open relief valve maintains a valve open state because the pilot pressure is maintained, and the hydraulic fluid is supplied to the second chamber via the check valve.

15. An electrohydrostatic actuation system comprising:

a hydraulic cylinder including:

a piston to which a valve element biased by a return spring is connected;

a first chamber; and a second chamber;

a hydraulic pump configured to supply hydraulic fluid to the first chamber or the second chamber, or to collect the hydraulic fluid from the first chamber or the second chamber;

an electric motor configured to drive the hydraulic pump;

a pilot-assisted open relief valve; and a check valve, wherein, in an operation of opening the valve element, the hydraulic fluid from the second chamber is blocked by the check valve, and the pilot-assisted open relief valve receives a pilot pressure by a pressure of the hydraulic fluid and is thus opened so that the hydraulic fluid from the second chamber flows through a drain line via the pilot-assisted open relief valve so as to be cooled, and wherein, in an operation of closing the valve element, the hydraulic fluid is supplied to the second chamber via the check valve.

* * * * *